US010453344B2

(12) United States Patent
Ishii et al.

(10) Patent No.: US 10,453,344 B2
(45) Date of Patent: Oct. 22, 2019

(54) INFORMATION PROCESSING APPARATUS AND NON-TRANSITORY RECORDING MEDIUM

(71) Applicant: Panasonic Intellectual Property Corporation of America, Torrance, CA (US)

(72) Inventors: Yasunori Ishii, Osaka (JP); Reiko Hagawa, Tokyo (JP); Ryota Fujimura, Kanagawa (JP)

(73) Assignee: PANASONIC INTELLECTUAL CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 15/883,026

(22) Filed: Jan. 29, 2018

(65) Prior Publication Data

US 2018/0233049 A1 Aug. 16, 2018

(30) Foreign Application Priority Data

Feb. 16, 2017 (JP) ..... 2017-027307
Sep. 25, 2017 (JP) ..... 2017-184071

(51) Int. Cl.
*G08G 1/09* (2006.01)
*G08G 1/16* (2006.01)
*G08G 1/04* (2006.01)

(52) U.S. Cl.
CPC ..... *G08G 1/167* (2013.01); *G08G 1/04* (2013.01); *G08G 1/162* (2013.01)

(58) Field of Classification Search
CPC ..... G08G 1/167; G08G 1/161; G08G 1/04; G08G 1/09; B60R 2300/802; B60R 2300/202; G01S 2013/9332
See application file for complete search history.

(56) References Cited

U.S. PATENT DOCUMENTS

2008/0243390 A1* 10/2008 Nakamori ..... G06K 9/00805 701/301
2009/0252380 A1* 10/2009 Shimizu ..... G08G 1/163 382/107

(Continued)

FOREIGN PATENT DOCUMENTS

DE 102012024959 A1 6/2014
EP 1469442 A2 10/2004
JP 2007-310457 11/2007

OTHER PUBLICATIONS

The Extended European Search Report dated Jun. 29, 2018 for European Patent Application No. 18156205.9.

*Primary Examiner* — Phung Nguyen
(74) *Attorney, Agent, or Firm* — Greenblum & Bernstein, P.L.C.

(57) ABSTRACT

An information processing apparatus obtains, from a right/left-turn vehicle, first obtaining information for providing an instruction to sense a blind-spot area of the right/left-turn vehicle, and determines whether to sense the blind-spot area on the basis of the first obtaining information. The information processing apparatus further obtains second obtaining information for determining a blind-spot area of the right/left-turn vehicle that is determined to be sensed, and generates first control information for controlling sensing of the blind-spot area determined from the obtained second obtaining information. Then, information processing apparatus outputs the first control information to a sensor or a first device, and outputs a sensing result received from the sensor or the first device to a second device or outputs to the first device the first control information and information for providing an instruction to output the sensing result to the second device.

17 Claims, 11 Drawing Sheets

(56) References Cited

U.S. PATENT DOCUMENTS

| | | | | |
|---|---|---|---|---|
| 2010/0066527 | A1* | 3/2010 | Liou | B60Q 9/008 340/461 |
| 2011/0095907 | A1* | 4/2011 | Kushi | B60W 30/0956 340/905 |
| 2014/0368330 | A1* | 12/2014 | Watanabe | G08G 1/16 340/475 |
| 2015/0232028 | A1* | 8/2015 | Reardon | B60R 1/00 348/148 |
| 2017/0174262 | A1* | 6/2017 | Kobayashi | B60Q 3/00 |
| 2017/0291545 | A1* | 10/2017 | Lai | B60Q 9/008 |
| 2018/0068191 | A1* | 3/2018 | Biemer | G06K 9/00825 |

* cited by examiner

INFORMATION PROCESSING APPARATUS AND NON-TRANSITORY RECORDING MEDIUM

BACKGROUND

1. Technical Field

The present disclosure relates to an information processing apparatus mountable on a vehicle and a non-transitory recording medium.

2. Description of the Related Art

In the related art, a system is disclosed (for example, Japanese Unexamined Patent Application Publication No. 2007-310457). In the system, a first vehicle detects a nearby moving object and transmits information on the detected moving object and information on the first vehicle (for example, the position of the first vehicle) to a second vehicle, and the second vehicle determines whether the moving object is hazardous by using received information.

For example, when a right-turn vehicle is to turn right at an intersection of roads each having a right-turn lane and a through lane, due to the presence of an oncoming vehicle in the right-turn lane in the opposite direction ahead of the right-turn vehicle, a portion of the through lane in the opposite direction may be a blind-spot area of the right-turn vehicle. In this case, a vehicle in the through lane in the opposite direction may appear from the blind-spot area and travel straight ahead through the intersection. To avoid collision, the right-turn vehicle needs to wait until the blind-spot area can be seen or wait until a dedicated right turn signal is turned on, for example. In Japanese Unexamined Patent Application Publication No. 2007-310457, an oncoming vehicle (first vehicle) detects a moving object in the surrounding area including a blind-spot area of a right-turn vehicle (second vehicle) and transmits information on the detected moving object to the right-turn vehicle, which enables the right-turn vehicle to perform control by using the transmitted information in accordance with traffic in a blind-spot area of the right-turn vehicle that occurs at an intersection. For example, the right-turn vehicle can turn right if no vehicle appearing from the blind-spot area and traveling straight ahead through the intersection, or can wait for a vehicle traveling straight ahead to pass through the intersection.

In Japanese Unexamined Patent Application Publication No. 2007-310457, however, the first vehicle, which detects unidentified nearby moving objects, may also transmit unnecessary information in addition to information about moving objects in the blind-spot area, which may lead to an increase in the amount of vehicle-to-vehicle (V2V) communication. As a result, there may be a shortage of network communication channels.

SUMMARY

One non-limiting and exemplary embodiment provides an information processing apparatus and a non-transitory recording medium storing thereon a computer program that enable control in accordance with traffic in a blind-spot area that occurs at an intersection with a low amount of communication.

In one general aspect, the techniques disclosed here feature an apparatus equipped in a vehicle. The apparatus includes a processor and a memory storing thereon a computer program, which when executed by the processor, causes the processor to perform operations including obtaining, from a right- or left-turn vehicle in a lane opposite to a lane in which the vehicle is currently located, first obtaining information for providing an instruction to sense a blind-spot area of the right- or left-turn vehicle; determining whether to sense a blind-spot area of the right- or left-turn vehicle in accordance with the first obtaining information; obtaining second obtaining information for determining a blind-spot area of the right- or left-turn vehicle that is determined to be sensed; generating first control information for controlling sensing of the blind-spot area determined from the obtained second obtaining information; and outputting the first control information. The outputting includes outputting the first control information to a sensor or a first device including the sensor and outputting a sensing result received from the sensor or the first device to a second device mounted on the right- or left-turn vehicle, or outputting to the first device the first control information and information for providing an instruction to output the sensing result to the second device.

According to aspects of the present disclosure, an information processing apparatus and a non-transitory recording medium storing thereon a computer program enable control in accordance with traffic in a blind-spot area that occurs at an intersection with a low amount of communication.

It should be noted that general or specific embodiments may be implemented as a system, an apparatus, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Underlying Knowledge Forming Basis of the Present Disclosure

Figure 1:
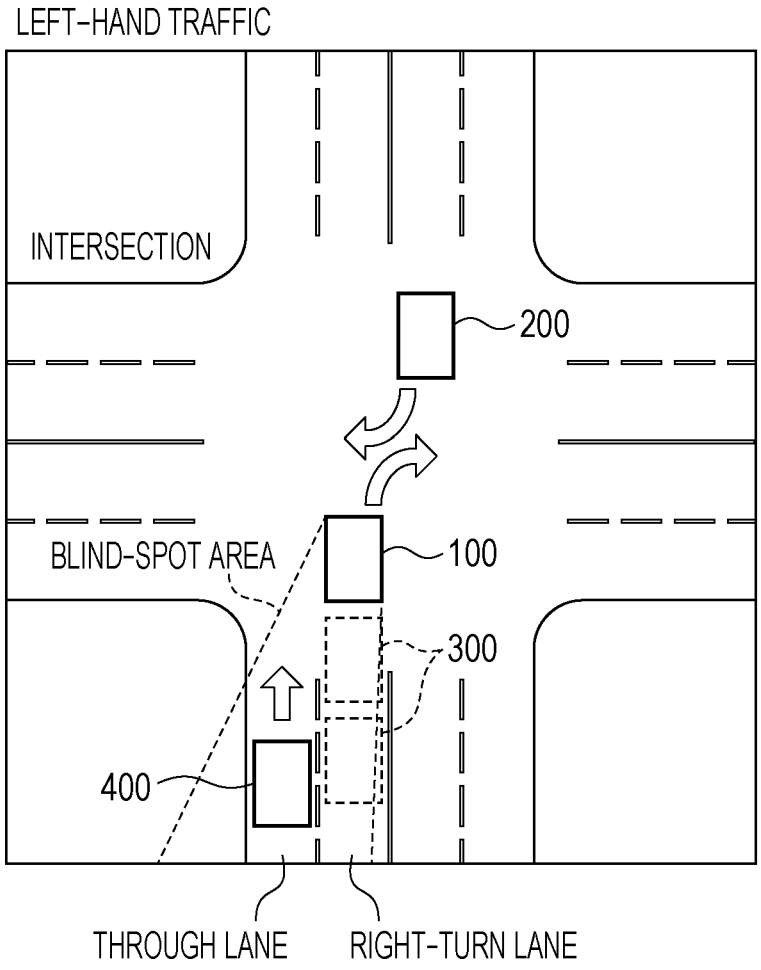
FIG. 1 is a diagram used to describe the occurrence of a blind-spot area at an intersection in a region with left-hand traffic.

In countries that use left-hand traffic, as illustrated in FIG. 1, vehicles keep to the left of the road in the direction of travel.

FIG. 1 is a diagram used to describe the occurrence of a blind-spot area at an intersection in a region with left-hand traffic.

When a vehicle (right-turn vehicle) 200 is to turn right at an intersection, a blind-spot area of the right-turn vehicle 200 (in FIG. 1, an area defined by a broken line) occurs due to the presence of a vehicle (oncoming vehicle) 100 in the right-turn lane in the opposite direction ahead of the right-turn vehicle 200. In this case, a vehicle (straight-ahead vehicle) 400 in a through lane may appear from the blind-spot area and travel straight ahead through the intersection. Thus, the right-turn vehicle 200 needs to wait until the blind-spot area can be seen or wait until a dedicated right turn signal is turned on, for example. In FIG. 1, vehicles (following vehicles) 300 that follow the oncoming vehicle 100 in the right-turn lane are also illustrated.

The development of automatic driving vehicles has been advanced recently. The automatic driving vehicles are each equipped with cameras (sensors) that capture images of the scenes ahead of, to the side of, and behind the automatic driving vehicle. For example, as illustrated in FIG. 2, each automatic driving vehicle senses an area surrounding the automatic driving vehicle.

Figure 2:
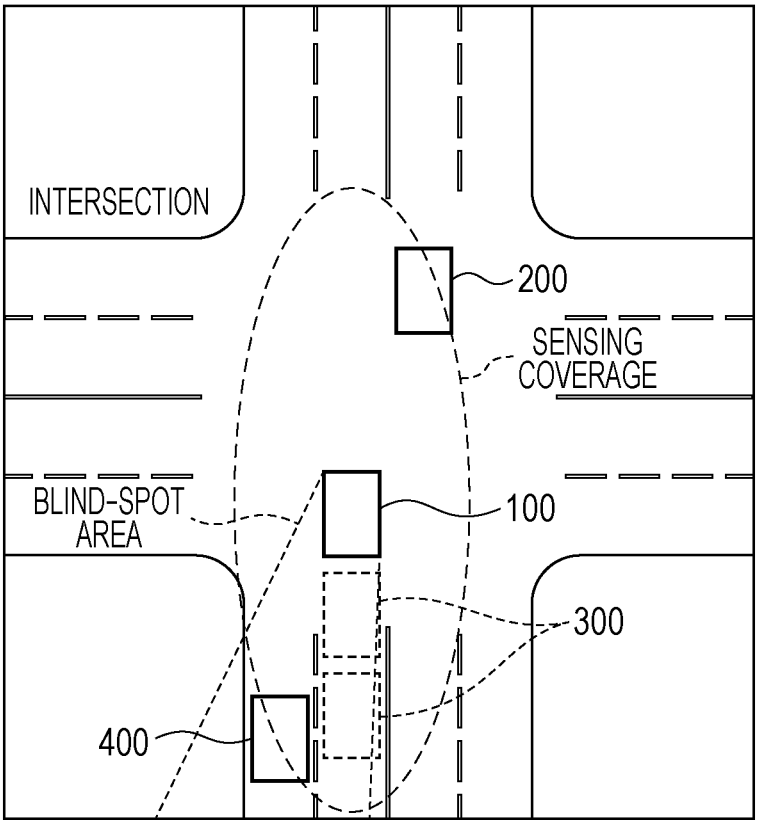
FIG. 2 is a diagram illustrating the sensing range of sensors included in a vehicle.

FIG. 2 is a diagram illustrating the sensing range of cameras (sensors) included in a vehicle. For example, the oncoming vehicle 100 is capable of sensing an area surrounding the oncoming vehicle 100. Thus, if the area surrounding the oncoming vehicle 100 includes a blind-spot area of the right-turn vehicle 200, the blind-spot area can be sensed by the oncoming vehicle 100. In the present disclosure, the state of traffic in a blind-spot area of the right-turn vehicle 200 is obtained by using cameras (sensors) mounted on the oncoming vehicle 100. Each of the vehicles 100, 200, and 300 is not limited to an automatic driving vehicle and may be a manual driving vehicle with an on-board camera such as a drive recorder.

Figure 3:
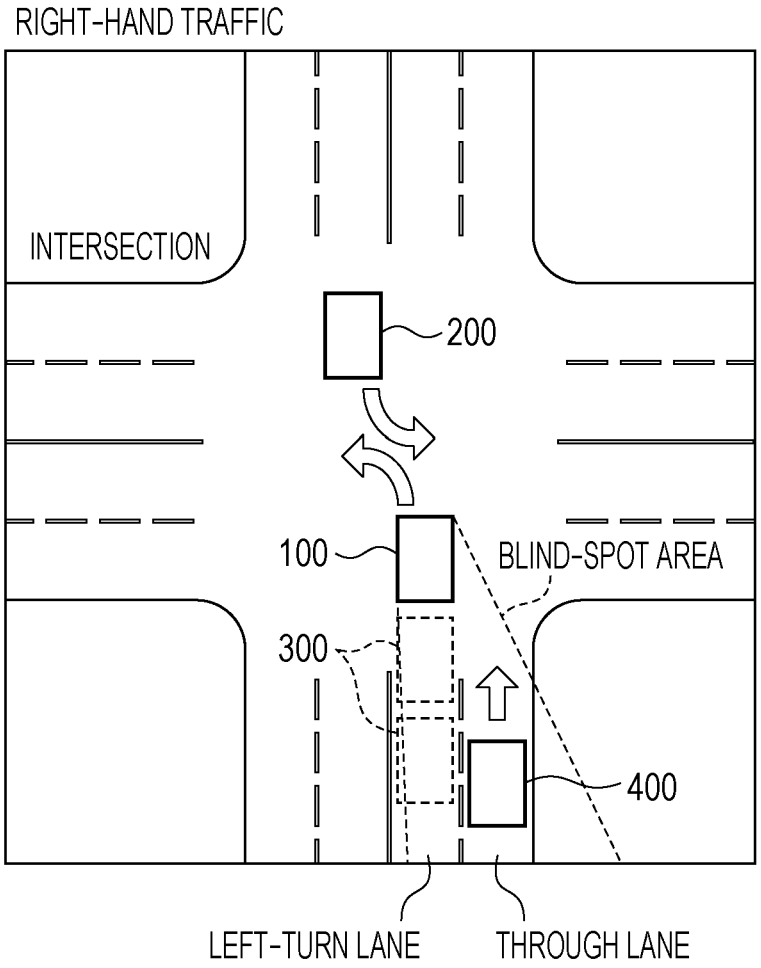
FIG. 3 is a diagram used to describe the occurrence of a blind-spot area at an intersection in a region with right-hand traffic.

In the following description, a focus is placed on vehicles in countries that use left-hand traffic. However, as illustrated in FIG. 3, the present disclosure may also be applied to vehicles in countries that use right-hand traffic. FIG. 3 is a diagram used to describe the occurrence of a blind-spot area at an intersection in a region with right-hand traffic. Hence, in the following description, "turn right" or its related expressions may also be read as "turn left" or its related expressions. In addition, "turn right" or its related expressions and "turn left" or its related expressions are collectively referred to also as "turn right/left" or its related expressions. For example, the vehicle 200 may be a right-turn vehicle (a vehicle that is to turn right), as illustrated in FIG. 1, or may be a left-turn vehicle (a vehicle that is to turn left), as illustrated in FIG. 3. Accordingly, the vehicle 200 is also referred to as a right/left-turn vehicle.

An apparatus according to an aspect of the present disclosure is equipped in a vehicle. The apparatus includes a processor and a memory storing thereon a computer program, which when executed by the processor, causes the processor to perform operations including obtaining, from a right- or left-turn vehicle in a lane opposite to a lane in which the vehicle is currently located, first obtaining information for providing an instruction to sense a blind-spot area of the right- or left-turn vehicle; determining whether to sense a blind-spot area of the right- or left-turn vehicle in accordance with the first obtaining information; obtaining second obtaining information for determining a blind-spot area of the right- or left-turn vehicle that is determined to be sensed; generating first control information for controlling sensing of the blind-spot area determined from the obtained second obtaining information; and outputting the first control information. The outputting includes outputting the first control information to a sensor or a first device including the sensor and outputting a sensing result received from the sensor or the first device to a second device mounted on the right- or left-turn vehicle, or outputting to the first device the first control information and information for providing an instruction to output the sensing result to the second device.

With this configuration, a blind-spot area of a right/left-turn vehicle that occurs when the right/left-turn vehicle is to turn right/left (to turn right or turn left) at an intersection is sensed in accordance with first obtaining information obtained from the right/left-turn vehicle, and information (sensing result) about a moving object in the blind-spot area is output to the right/left-turn vehicle (second device) directly or via a first device (for example, a device mounted on a vehicle in the vicinity of the vehicle on which the apparatus is mounted). This configuration enables the right/left-turn vehicle to flexibly (comfortably) determine whether to turn right/left. In addition, information (sensing result) about a moving object in the blind-spot area, rather than information about all moving objects around the vehicle, is output to the right/left-turn vehicle, which can lead to a reduction in the amount of vehicle-to-vehicle communication. In this way, it may be possible to perform control in accordance with traffic in a blind-spot area that occurs at an intersection with a low amount of communication. Furthermore, an instruction is transmitted from the right/left-turn vehicle to sense the blind-spot area when the right/left-turn vehicle is to turn right/left, and accordingly whether to sense the blind-spot area can be easily determined.

An apparatus according to another aspect of the present disclosure is equipped in a vehicle. The apparatus includes a processor and a memory storing thereon a computer program, which when executed by the processor, causes the processor to perform operations including obtaining third obtaining information indicating an image in which another vehicle in a lane opposite to a lane in which the vehicle is currently located appears; determining, based on whether the other vehicle appearing in the image indicated by the third obtaining information is a right- or left-turn vehicle, whether to sense a blind-spot area of the right- or left-turn vehicle; obtaining second obtaining information for determining a blind-spot area of the right- or left-turn vehicle that is determined to be sensed; generating first control information for controlling sensing of the blind-spot area determined from the obtained second obtaining information; and outputting the first control information. The outputting includes outputting the first control information to a sensor or a first device including the sensor and outputting a sensing result received from the sensor or the first device to a second device mounted on the right- or left-turn vehicle, or outputting to the first device the first control information and information for providing an instruction to output the sensing result to the second device.

With this configuration, a blind-spot area of a right/left-turn vehicle that occurs when the right/left-turn vehicle is to turn right/left at an intersection is sensed in accordance with third obtaining information obtained from, for example, a camera or the like mounted on the subject vehicle, and information (sensing result) about a moving object in the blind-spot area is output to the right/left-turn vehicle (second device) directly or via the first device. This configuration enables the right/left-turn vehicle to flexibly determine whether to turn right/left. In addition, a result of sensing the blind-spot area, rather than information about all moving objects around the vehicle, is output to the right/left-turn vehicle, which can lead to a reduction in the amount of vehicle-to-vehicle communication. In this way, it may be possible to perform control in accordance with traffic in a blind-spot area that occurs at an intersection with a low amount of communication. Furthermore, an image obtained by a camera or the like can be used to determine whether the right/left-turn vehicle is to turn right/left, and accordingly whether to sense the blind-spot area can be easily determined.

The blind-spot area may include a blind-spot area that occurs due to presence of the vehicle.

This configuration enables control in accordance with traffic in a blind-spot area that occurs at an intersection due to the presence of a vehicle (oncoming vehicle) in the lane opposite to the lane in which the right/left-turn vehicle is currently located.

The obtaining of the second obtaining information may calculate the blind-spot area on the basis of a positional relationship between the vehicle and the right- or left-turn vehicle to obtain the second obtaining information.

This configuration enables the vehicle (oncoming vehicle) to obtain the second obtaining information by calculating a blind-spot area of the right/left-turn vehicle that occurs due to the presence of the vehicle (oncoming vehicle).

Alternatively, the obtaining of the second obtaining information may obtain the second obtaining information from the right- or left-turn vehicle.

This configuration eliminates the need for the vehicle (oncoming vehicle) to calculate a blind-spot area of the right/left-turn vehicle that occurs due to the presence of the vehicle (oncoming vehicle), and enables the vehicle (oncoming vehicle) to obtain the second obtaining information from the right/left-turn vehicle.

In addition, the operations may further include obtaining first position information indicating a position of the vehicle and second position information indicating a position of at least one vehicle in a range of vehicles with which the apparatus is capable of communicating. The first device may include a device mounted on a following vehicle that follows the vehicle. The generating may identify the device mounted on the following vehicle by using the first position information and the second position information. The outputting may output the first control information to the identified device mounted on the following vehicle.

With this configuration, a blind-spot area is sensed by a following vehicle that follows a vehicle (oncoming vehicle) in the lane opposite to the lane in which the right/left-turn vehicle is currently located, and information (sensing result) about a moving object in the blind-spot area is output from the following vehicle. This configuration enables the right/left-turn vehicle to obtain information about a moving object in a blind-spot area of the right/left-turn vehicle that is behind the oncoming vehicle and that is out of the sensing coverage around the oncoming vehicle.

An apparatus according to still another aspect of the present disclosure is equipped in a vehicle. The apparatus includes a processor and a memory storing thereon a computer program, which when executed by the processor, causes the processor to perform operations including detecting, by the vehicle, a right or left turn of the vehicle; determining whether to calculate a blind-spot area of the vehicle in response to the vehicle detecting a right or left turn of the vehicle; calculating a blind-spot area of the vehicle in accordance with information on surroundings of the vehicle; outputting information indicating the blind-spot area; receiving a result of sensing the blind-spot area; generating travel assistance information for assisting travel of the vehicle in accordance with the result of sensing the blind-spot area; and outputting the travel assistance information to a device mounted on the vehicle.

With this configuration, a blind-spot area of a right/left-turn vehicle that occurs when the vehicle (right/left-turn vehicle) is to turn right/left at an intersection is sensed, and the right/left-turn vehicle obtains information (sensing result) about a moving object in the blind-spot area. This configuration enables the right/left-turn vehicle to flexibly (comfortably) determine whether to turn right/left. In addition, the right/left-turn vehicle obtains information (sensing result) about a moving object in the blind-spot area, rather than information about all moving objects around an oncoming vehicle in the lane opposite to the lane in which the right/left-turn vehicle is currently located, which can lead to a reduction in the amount of vehicle-to-vehicle communication. In this way, it may be possible to perform control in accordance with traffic in a blind-spot area that occurs at an intersection with a low amount of communication.

The blind-spot area may include a blind-spot area that occurs due to presence of an oncoming vehicle in a lane opposite to a lane in which the vehicle is currently located.

This configuration enables control in accordance with traffic in a blind-spot area that occurs at an intersection due to presence of the oncoming vehicle.

The calculating may calculate the blind-spot area on the basis of a positional relationship between the vehicle and the oncoming vehicle. The outputting of the information indicating the blind-spot area may output the information indicating the blind-spot area to the oncoming vehicle via communication.

With this configuration, the vehicle (right/left-turn vehicle) calculates a blind-spot area of the vehicle (right/left-turn vehicle) that occurs due to the presence of the oncoming vehicle and outputs information on the calculated blind-spot area to the oncoming vehicle. Thus, the oncoming vehicle can obtain information indicating the blind-spot area.

The detecting may detect a right or left turn of the vehicle in accordance with information indicating turning on of a directional indicator included in the vehicle. The detecting may include detecting, by a detector included in the vehicle, a right or left turn of the vehicle.

With this configuration, a right/left turn of the vehicle (subject vehicle) is detected by the subject vehicle in accordance with the turning on of a directional indicator included in the subject vehicle.

Alternatively, the detecting may include detecting, by an oncoming vehicle in a lane opposite to a lane in which the vehicle is currently located, a right or left turn of the vehicle. The determining may determine whether to calculate the blind-spot area of the vehicle in accordance with a result of detecting a right or left turn of the vehicle, the result being received from the oncoming vehicle.

With this configuration, a right/left turn of the vehicle (subject vehicle) is detected by an oncoming vehicle.

Alternatively, the generating may generate the travel assistance information to make the vehicle stop turning right or left when the result of sensing the blind-spot indicates presence of an object in the blind-spot area.

This configuration may prevent the vehicle from colliding with a moving object that appears from a blind-spot area of the vehicle.

Alternatively, the generating may generate the travel assistance information to allow the vehicle to turn right or left when the result of sensing the blind-spot indicates no object in the blind-spot area.

This configuration may prevent the vehicle from stopping or slowing down more than necessary when there is no concern of a moving object that appears from a blind-spot area of the vehicle, which enables the vehicle to comfortably turn right/left at the intersection.

Alternatively, the travel assistance information may be information for controlling travel of the vehicle.

This configuration can control the travel of the vehicle (to determine whether to turn right/left or to be kept at standstill) in accordance with the state of traffic in a blind-spot area that occurs at an intersection.

Alternatively, the travel assistance information may be information to be presented to a passenger of the vehicle.

This configuration enables information about the travel of the vehicle (to determine whether to turn right/left or to be kept at standstill) to be presented to a passenger of the vehicle in accordance with traffic in a blind-spot area that occurs at an intersection.

A non-transitory recording medium according to still another aspect of the present disclosure stores thereon a computer program for controlling an apparatus equipped in a vehicle, which when executed by the processor, causes the processor to perform operations including obtaining, from a right- or left-turn vehicle in a lane opposite to a lane in which the vehicle is currently located, first obtaining information for providing an instruction to sense a blind-spot area of the right- or left-turn vehicle; determining whether to sense a blind-spot area of the right- or left-turn vehicle in accordance with the first obtaining information; obtaining second obtaining information for determining a blind-spot area of the right- or left-turn vehicle that is determined to be sensed; generating first control information for controlling sensing of the blind-spot area determined from the obtained second obtaining information; and outputting the first control information to a sensor or a first device including the sensor and outputting a sensing result received from the sensor or the first device to a second device mounted on the right- or left-turn vehicle, or outputting to the first device the first control information and information for providing an instruction to output the sensing result to the second device.

A non-transitory recording medium according to still another aspect of the present disclosure stores thereon a computer program for controlling an apparatus equipped in a vehicle, which when executed by the processor, causes the processor to perform operations including obtaining third obtaining information indicating an image in which another vehicle in a lane opposite to a lane in which the vehicle is currently located appears; determining, based on whether the other vehicle appearing in the image indicated by the third obtaining information is a right- or left-turn vehicle, whether to sense a blind-spot area of the right- or left-turn vehicle; obtaining second obtaining information for determining a blind-spot area of the right- or left-turn vehicle that is determined to be sensed; generating first control information for controlling sensing of the blind-spot area determined from the obtained second obtaining information; and outputting the first control information to a sensor or a first device including the sensor and outputting a sensing result received from the sensor or the first device to a second device mounted on the right- or left-turn vehicle, or outputting to the first device the first control information and information for providing an instruction to output the sensing result to the second device.

A non-transitory recording medium according to still another aspect of the present disclosure stores thereon a computer program for controlling an apparatus equipped in a vehicle, which when executed by the processor, causes the processor to perform operations including detecting, by the vehicle, a right or left turn of the vehicle; determining whether to calculate a blind-spot area of the vehicle in response to the vehicle detecting a right or left turn of the vehicle; calculating a blind-spot area of the vehicle in accordance with information on surroundings of the vehicle; outputting information indicating the blind-spot area; receiving a result of sensing the blind-spot area; generating travel assistance information for assisting travel of the vehicle in accordance with the result of sensing the blind-spot area; and outputting the travel assistance information to a device mounted on the vehicle.

Accordingly, it may be possible to provide a non-transitory recording medium storing thereon a computer program that can perform control in accordance with traffic in a blind-spot area that occurs at an intersection with a low amount of communication.

Embodiments will be specifically described with reference to the drawings.

It should be noted that the following embodiments are general or specific examples. Numerical values, shapes, constituent elements, arranged positions and connection forms of the constituent elements, steps, the order of the steps, and so on in the following embodiments are merely examples and are not intended to limit the present disclosure. The constituent elements mentioned in the following embodiments are described as optional constituent elements unless they are specified in the independent claim that defines the present disclosure in its broadest concept.

First Embodiment

In the following, a first embodiment will be described with reference to FIGS. 4 to 6.

1-1. Configuration of Oncoming Vehicle and Right-Turn Vehicle

Figure 4:
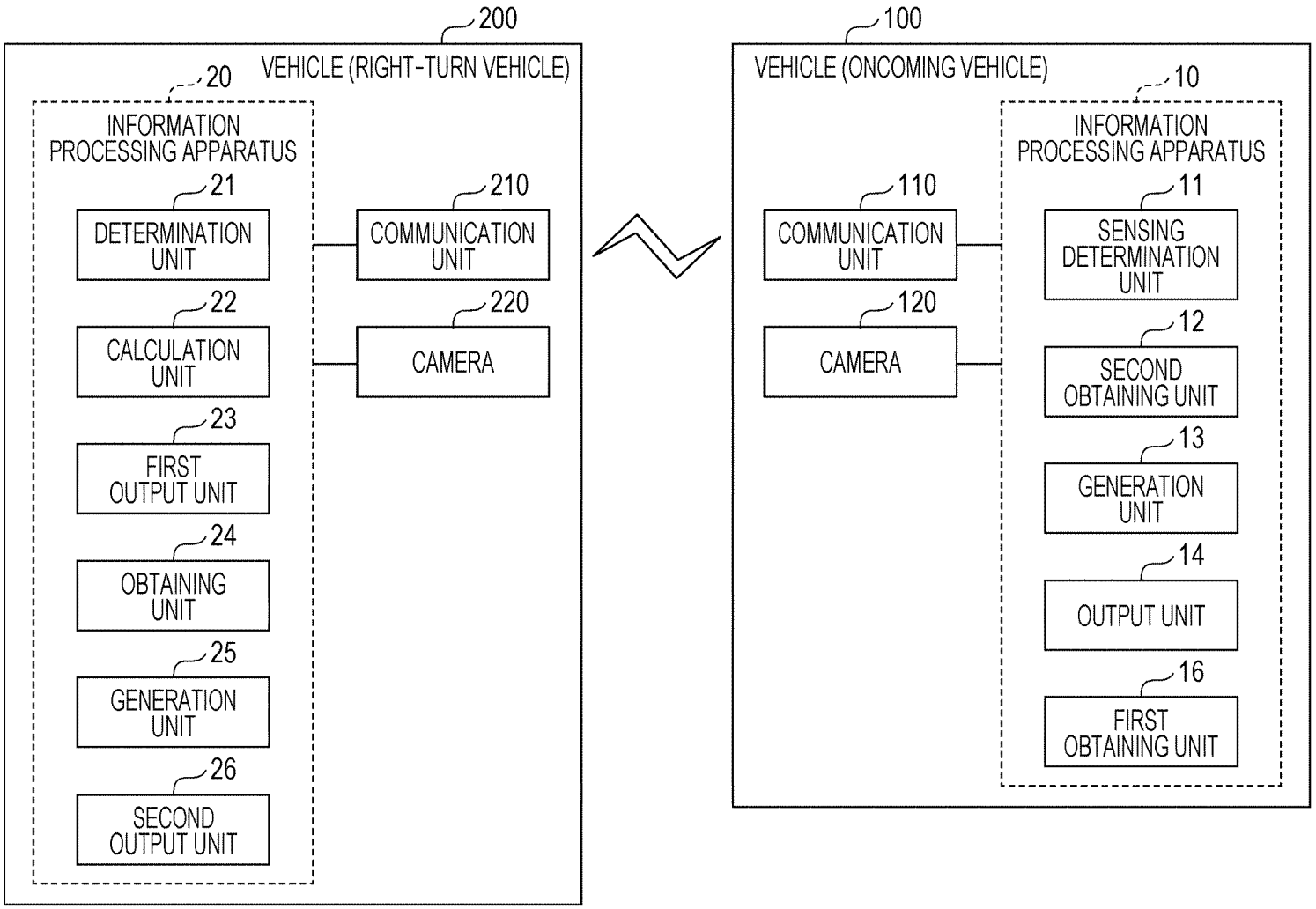
FIG. 4 is a block diagram illustrating an example configuration of a vehicle according to a first embodiment.

FIG. 4 is a block diagram illustrating an example configuration of the vehicles 100 and 200 according to the first embodiment.

As illustrated in FIG. 4, the vehicle (oncoming vehicle) 100 includes an information processing apparatus 10, a communication unit 110, and a camera 120, and the vehicle (right-turn vehicle) 200 includes an information processing apparatus 20, a communication unit 210, and a camera 220.

The information processing apparatus 10 is constituted by, for example, a single electronic control unit (ECU) or a plurality of ECUs connected over an in-vehicle network and performs control regarding communication performed by the communication unit 110 and sensing performed by the camera 120. The information processing apparatus 10 includes a first obtaining unit 16, a sensing determination unit 11, a second obtaining unit 12, a generation unit 13, and an output unit 14.

The first obtaining unit 16 obtains, from the right/left-turn vehicle (right-turn vehicle) 200 ahead of the vehicle (oncoming vehicle) 100, first obtaining information for providing an instruction to sense a blind-spot area of the right/left-turn vehicle (right-turn vehicle) 200.

The sensing determination unit 11 determines whether to sense a blind-spot area of the right/left-turn vehicle (right-turn vehicle) 200 in accordance with the first obtaining information.

The second obtaining unit 12 obtains second obtaining information for determining a blind-spot area of the right/left-turn vehicle (right-turn vehicle) 200 that is determined to be sensed by the sensing determination unit 11. For example, the second obtaining unit 12 obtains the second obtaining information by calculating a blind-spot area on the basis of the positional relationship between the vehicle (oncoming vehicle) 100 and the right/left-turn vehicle (right-turn vehicle) 200. The second obtaining unit 12 may obtain the second obtaining information from the right/left-turn vehicle (right-turn vehicle) 200. The blind-spot area includes, as illustrated in FIG. 1, a blind-spot area that occurs due to the presence of the vehicle (oncoming vehicle) 100.

The generation unit 13 generates first control information for controlling the sensing of the blind-spot area determined from the second obtaining information obtained by the second obtaining unit 12. In this embodiment, the first control information is information for controlling the vehicle (oncoming vehicle) 100 to sense a blind-spot area and output a sensing result.

The output unit 14 outputs the first control information. The output unit 14 outputs the first control information to a sensor (for example, the camera 120 mounted on the vehicle 100) and outputs a sensing result received from the sensor (the camera 120) to a second device mounted on the right/left-turn vehicle (right-turn vehicle) 200. In this embodiment, the output unit 14 outputs a sensing result obtained by the sensor (the camera 120) mounted on the vehicle (oncoming vehicle) 100 to the right-turn vehicle 200 (second device) via the communication unit 110.

The communication unit 110 is, for example, a communication interface that communicates with other vehicles and the like, and wirelessly communicates with the communication unit 210 included in the right-turn vehicle 200.

The camera 120 is, for example, a sensor capable of capturing images of the surroundings (for example, 360-degree surroundings) of the oncoming vehicle 100. The camera 120 is constituted by, for example, a plurality of cameras on the front, the sides, and the rear of the oncoming vehicle 100. A portion of the imaging area of the camera 120 is a blind-spot area of the right-turn vehicle 200. The camera 120 may be a camera having a viewing angle of 360 degrees.

The operation of the oncoming vehicle 100 will be described in detail with reference to FIG. 5 described below.

The information processing apparatus 20 is constituted by, for example, a single ECU or a plurality of ECUs connected over an in-vehicle network and performs control regarding communication performed by the communication unit 210 and sensing performed by the camera 220. The information processing apparatus 20 is the second device described above, for example. Further, the information processing apparatus 20 includes, for example, ECUs that control the engine, brakes, steering wheel, and so on and controls the travel of the right-turn vehicle 200. The information processing apparatus 20 includes a determination unit 21, a calculation unit 22, a first output unit 23, an obtaining unit 24, a generation unit 25, and a second output unit 26.

The determination unit 21 determines whether to calculate a blind-spot area of the vehicle (right-turn vehicle) 200 in response to detection of a right/left turn (a right turn) of the vehicle (right-turn vehicle) 200. In this embodiment, the vehicle (right-turn vehicle) 200 detects a right/left turn (a right turn) of the vehicle (right-turn vehicle) 200. For example, the information processing apparatus 20 further includes a detector that detects a right/left turn (a right turn) of the vehicle (right-turn vehicle) 200 on the basis of information indicating turning on of a directional indicator of the vehicle (right-turn vehicle) 200. The detection of a right/left turn (a right turn) of the vehicle (right-turn vehicle) 200 includes detecting, by using the detector, a right/left turn (a right turn) of the vehicle (right-turn vehicle) 200. For example, the right-turn vehicle 200 detects a right turn of the right-turn vehicle 200 when the right-turn directional indicator of the right-turn vehicle 200 is turned on.

The calculation unit 22 calculates a blind-spot area of the vehicle (right-turn vehicle) 200 on the basis of information on the surroundings of the vehicle (right-turn vehicle) 200. The information on the surroundings of the right-turn vehicle 200 is information about objects around the right-turn vehicle 200. Specifically, the calculation unit 22 calculates a blind-spot area of the vehicle (right-turn vehicle) 200 on the basis of the positional relationship between the vehicle (right-turn vehicle) 200 and the vehicle (oncoming vehicle) 100.

The first output unit 23 outputs information indicating the blind-spot area calculated by the calculation unit 22 to the communication unit 210. Specifically, the first output unit 23 provides the information indicating the blind-spot area to the vehicle (oncoming vehicle) 100 via the communication unit 210.

The obtaining unit 24 receives a result of sensing a blind-spot area. Specifically, the obtaining unit 24 receives a result of sensing a blind-spot area from the oncoming vehicle 100 via the communication unit 210.

The generation unit 25 generates travel assistance information for assisting the travel of the vehicle (right-turn vehicle) 200 on the basis of the sensing result. In this embodiment, the travel assistance information is information for controlling the travel of the vehicle (right-turn vehicle) 200. Specifically, if the sensing result indicates the presence of an object in the blind-spot area, the generation unit 25 generates travel assistance information for making the vehicle (right-turn vehicle) 200 stop turning right/left (turning right). If the sensing result indicates no object in the blind-spot area, the generation unit 25 generates travel assistance information for allowing the vehicle (right-turn vehicle) 200 to turn right/left (to turn right). This enables the right-turn vehicle 200 to come to a stop when an object is in the blind-spot area and to safely turn right when no object is in the blind-spot area.

The second output unit 26 outputs the travel assistance information to a device (e.g., an ECU) mounted on the vehicle (right-turn vehicle) 200. For example, the second output unit 26 outputs travel control information to ECUs such as a chassis ECU associated with control of vehicle behaviors such as "turn" and "stop" and a powertrain-related ECU associated with control of vehicle behaviors such as "accelerate" and "decelerate". The chassis ECU is connected to the steering wheel, brakes, and so on, and the powertrain-related ECU is connected to the engine or hybrid system and so on. In FIG. 4, the first output unit 23 and the second output unit 26 are illustrated as separate units. Alternatively, the first output unit 23 and the second output unit 26 may be formed into a single functional constituent element. In this way, the constituent elements of the information processing apparatus 20 may be included in a single ECU or may be disposed in the respective ECUs in a distributed manner.

The communication unit 210 is a communication interface that communicates with other vehicles and the like, and wirelessly communicates with the communication unit 110 included in the oncoming vehicle 100.

The camera 220 is, for example, a sensor capable of capturing images of the surroundings (for example, 360-degree surroundings) of the right-turn vehicle 200. The camera 220 is constituted by, for example, a plurality of cameras on the front, the sides, and the rear of the right-turn vehicle 200. The camera 220 may be a camera having a viewing angle of 360 degrees.

The operation of the right-turn vehicle 200 will be described in detail with reference to FIG. 5 described below.

Each ECU is a device including digital circuits such as a processor (microprocessor) and a memory, analog circuits, a communication circuit, and so on. The memory, such as a read-only memory (ROM) or a random access memory (RAM), is capable of storing a control program (computer program) to be executed by the processor. For example, the processor operates in accordance with the control program (computer program), thereby allowing the information processing apparatus 10 to implement various functions (the first obtaining unit 16, the sensing determination unit 11, the second obtaining unit 12, the generation unit 13, and the output unit 14) and allowing the information processing apparatus 20 to implement various functions (the determination unit 21, the calculation unit 22, the first output unit 23, the obtaining unit 24, the generation unit 25, and the second output unit 26).

1-2. Operation of Oncoming Vehicle and Right-Turn Vehicle

Next, the operation of the oncoming vehicle 100 and the right-turn vehicle 200 will be described with reference to FIG. 5.

Figure 5:
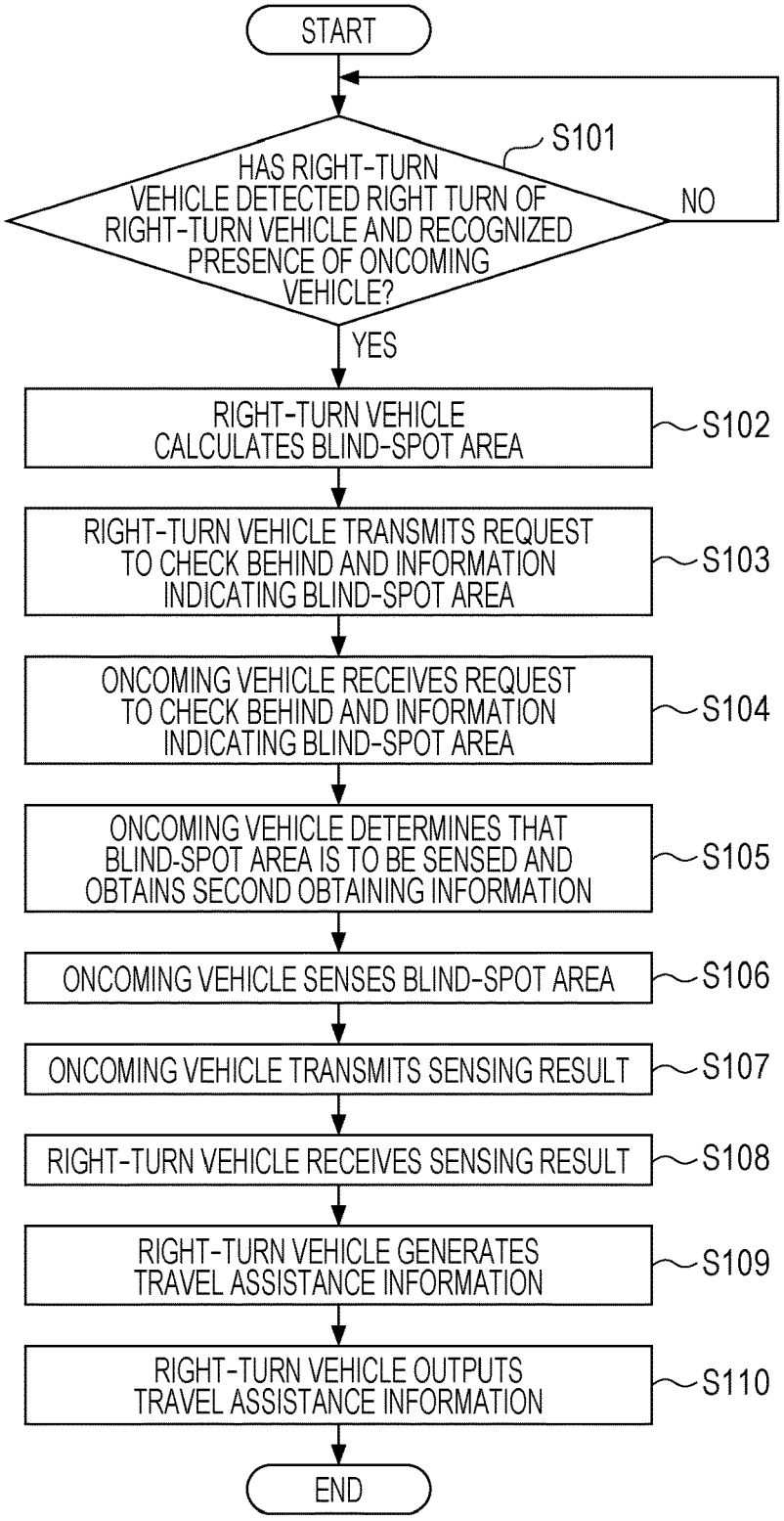
FIG. 5 is a flowchart illustrating an example operation of the vehicle according to the first embodiment.

FIG. 5 is a flowchart illustrating an example operation of the vehicles 100 and 200 according to the first embodiment.

First, the right-turn vehicle 200 determines whether the right-turn vehicle 200 has detected a right turn of the right-turn vehicle 200 and has recognized the presence of the oncoming vehicle 100 (step S101). In accordance with the determination, the determination unit 21 determines whether to calculate a blind-spot area of the right-turn vehicle 200. Specifically, if the presence of the oncoming vehicle 100 has been recognized when the right-turn vehicle 200 detects a right turn of the right-turn vehicle 200, the determination unit 21 determines that a blind-spot area of the right-turn vehicle 200 is to be calculated. If the right-turn vehicle 200 has not detected a right turn of the right-turn vehicle 200 or if the right-turn vehicle 200 has detected a right turn of the right-turn vehicle 200 but has not recognized the presence of the oncoming vehicle 100, the determination unit 21 determines that a blind-spot area of the right-turn vehicle 200 is not to be calculated. In the first embodiment, in this way, the determination unit 21 determines whether to calculate a blind-spot area of the right-turn vehicle 200 on the basis of the detection of a right turn of the right-turn vehicle 200 which is performed by the right-turn vehicle 200. The right-turn vehicle 200 may detect a right turn of the right-turn vehicle 200 (subject vehicle) by using any method. For example, a turning right of the subject vehicle may be detected from information on a path to the destination. Further, the right-turn vehicle 200 recognizes the presence of the oncoming vehicle 100 by capturing the scene ahead of the right-turn vehicle 200 by using the camera 220.

If it is determined that the right-turn vehicle 200 has detected a right turn of the right-turn vehicle 200 and has recognized the presence of the oncoming vehicle 100 (YES in step S101), the calculation unit 22 (the right-turn vehicle 200) calculates a blind-spot area of the right-turn vehicle 200 (step S102). Specifically, the calculation unit 22 calculates a blind-spot area of the right-turn vehicle 200 from an image of the scene ahead of the right-turn vehicle 200, which is obtained by the camera 220. For example, if a blind-spot area of the right-turn vehicle 200 occurs due to the presence of the oncoming vehicle 100 ahead of the right-turn vehicle 200, the calculation unit 22 calculates an area within which the oncoming vehicle 100 appears on the image as a blind-spot area.

Then, the first output unit 23 (the right-turn vehicle 200) transmits to the oncoming vehicle 100 a request to check an area that corresponds to the blind-spot area of the right-turn vehicle 200 and that is behind the oncoming vehicle 100 (in other words, an instruction to sense the blind-spot area) and information indicating the blind-spot area calculated by the calculation unit 22 (step S103). Specifically, the first output unit 23 outputs the request and the information to the communication unit 210, and the communication unit 210 transmits the request and the information to the communication unit 110 included in the oncoming vehicle 100.

The oncoming vehicle 100 receives the request and the information transmitted from the right-turn vehicle 200 (step S104). Specifically, the oncoming vehicle 100 receives the request and the information via the communication unit 110. As a result, the first obtaining unit 16 obtains the request (first obtaining information).

Then, the sensing determination unit 11 determines whether to sense the blind-spot area in accordance with the first obtaining information (for example, a request to check behind the oncoming vehicle 100). Specifically, the sensing determination unit 11 determines that the blind-spot area is to be sensed when the first obtaining unit 16 has obtained the first obtaining information, and determines that the blind-spot area is not to be sensed when the first obtaining unit 16 has not obtained the first obtaining information. Accordingly, the sensing determination unit 11 (the oncoming vehicle 100) determines that the blind-spot area is to be sensed, and the second obtaining unit 12 obtains second obtaining information for determining a blind-spot area of the right-turn vehicle 200 that is determined to be sensed by the sensing determination unit 11 (step S105). In this way, first obtaining information for providing an instruction to sense a blind-spot area of the right-turn vehicle 200 is transmitted from the right-turn vehicle 200 when the right-turn vehicle 200 is to turn right, and accordingly whether to sense the blind-spot area can be easily determined.

In step S103, both a request to check an area behind the oncoming vehicle 100 and information indicating a blind-spot area of the right-turn vehicle 200 are transmitted. Alternatively, only the request may be transmitted first. Then, when it is determined in response to the request that a blind-spot area of the right-turn vehicle 200 is to be sensed, the oncoming vehicle 100 may provide a request to the right-turn vehicle 200 to transmit information indicating the blind-spot area calculated by the right-turn vehicle 200, and the right-turn vehicle 200 may transmit information indicating the blind-spot area to the oncoming vehicle 100 in response to the request.

Then, the generation unit 13 (the oncoming vehicle 100) generates first control information for controlling the sensing of the blind-spot area determined from the second obtaining information. Specifically, the oncoming vehicle 100 senses the blind-spot area (step S106). Then, the output unit 14 (the oncoming vehicle 100) outputs the first control information to a sensor (for example, the camera 120 mounted on the oncoming vehicle 100) and transmits a sensing result received from the sensor to the second device mounted on the right-turn vehicle 200 (step S107). In the first embodiment, in this way, the oncoming vehicle 100 senses a blind-spot area, and the oncoming vehicle 100 outputs a sensing result. The sensing result includes, for example, information indicating the presence or non-presence of a moving object (for example, the straight-ahead vehicle 400) in the blind-spot area, information indicating the distance from the intersection to the moving object in the blind-spot area, information indicating the speed of the moving object in the blind-spot area, or the like. The speed of a moving object may be calculated by using the frame rate of the camera 120 and by using a change in the position of the moving object appearing in images of individual frames obtained by the camera 120.

The obtaining unit 24 (the right-turn vehicle 200) receives the sensing result transmitted from the oncoming vehicle 100 (step S108). Specifically, the obtaining unit 24 receives the sensing result via the communication unit 210.

Then, the generation unit 25 (the right-turn vehicle 200) generates travel assistance information for assisting the travel of the right-turn vehicle 200 on the basis of the sensing result (step S109), and the second output unit 26 (the right-turn vehicle 200) outputs the travel assistance information to the second device mounted on the right-turn vehicle 200 (step S110). For example, if it is determined, based on the sensing result, that no moving object is in the blind-spot area, a moving object is in the blind-spot area but is away from the intersection, or a moving object is in the blind-spot area but has a low speed, the generation unit 25 generates travel assistance information for allowing the right-turn vehicle 200 to turn right. For example, if it is determined, based on the sensing result, that a moving object is in the blind-spot area, a moving object is in the blind-spot area and is close to the intersection, or a moving object is in the blind-spot area and has a high speed, the generation unit 25 generates travel assistance information for making the right-turn vehicle 200 come to a stop.

1-3. Blind-Spot Area

Next, a method for calculating a blind-spot area of the right-turn vehicle 200 that occurs due to the presence of the oncoming vehicle 100 will be described with reference to FIG. 6.

Figure 6:
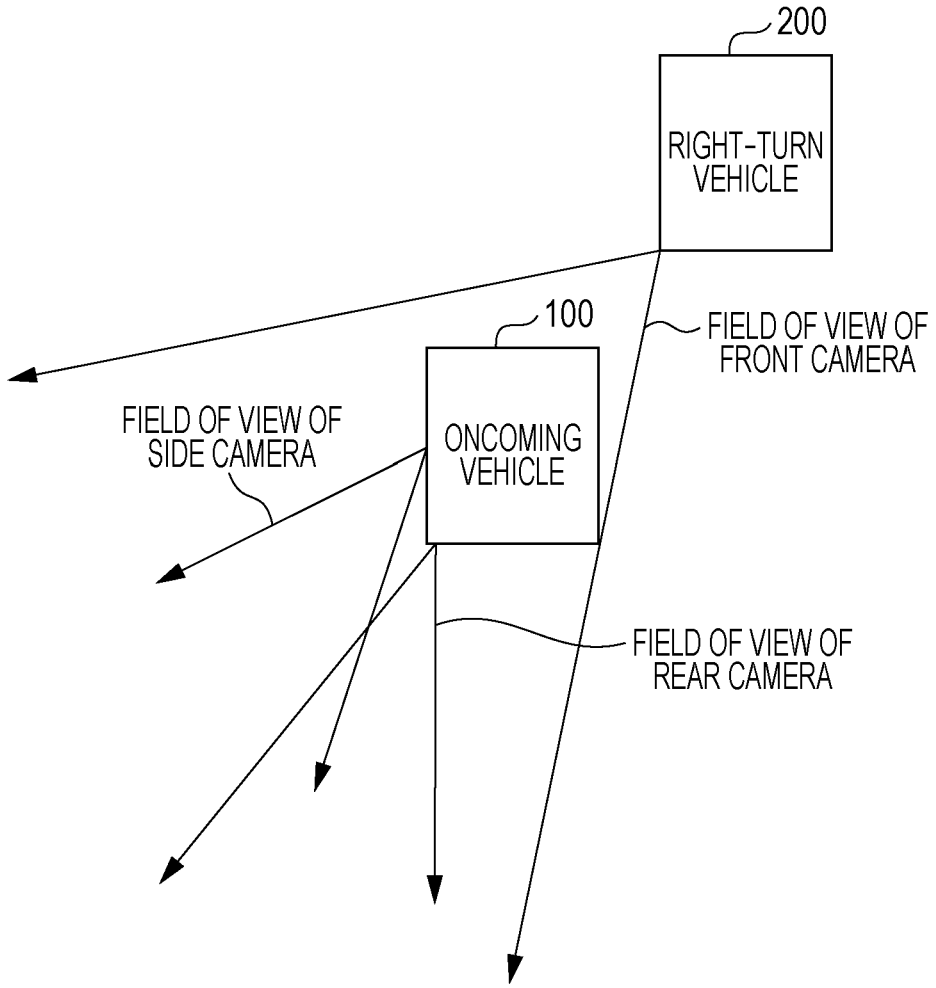
FIG. 6 is a diagram illustrating an example method for calculating a blind-spot area.

FIG. 6 is a diagram illustrating an example method for calculating a blind-spot area. It is assumed that the oncoming vehicle 100 has recognized the positional relationship between the oncoming vehicle 100 and the right-turn vehicle 200 (specifically, the positional relationship between the camera 120 and the camera 220). For example, the oncoming vehicle 100 is capable of recognizing the positional relationship between the oncoming vehicle 100 and the right-turn vehicle 200 from an image obtained by capturing the scene ahead of the oncoming vehicle 100 by using the camera 120. For example, the oncoming vehicle 100 and the right-turn vehicle 200 may include a Global Positioning System (GPS) sensor. The oncoming vehicle 100 is capable of recognizing the positional relationship between the oncoming vehicle 100 and the right-turn vehicle 200 by obtaining information on the position of the right-turn vehicle 200 from the right-turn vehicle 200.

The right-turn vehicle 200 captures the scene ahead of the right-turn vehicle 200 by using the camera 220 to obtain an image of the scene ahead of the right-turn vehicle 200. The right-turn vehicle 200 calculates a range within which the oncoming vehicle 100 appears on the image (a range within which the oncoming vehicle 100 is seen in the field of view of the front camera illustrated in FIG. 6) as a blind-spot area and transmits information indicating the blind-spot area to the oncoming vehicle 100. The oncoming vehicle 100 calculates the ranges on images obtained by capturing the scenes behind and to each side of the oncoming vehicle 100 by using the camera 120 (the ranges of the fields of view of the rear and side cameras illustrated in FIG. 6), which correspond to the range within which the oncoming vehicle 100 appears on the image obtained by capturing the scene ahead of the right-turn vehicle 200 by using the camera 220, from the positional relationship between the oncoming vehicle 100 and the right-turn vehicle 200, and recognizes the ranges as blind-spot areas.

1-4. Advantages, etc.

As described above, a blind-spot area of the right-turn vehicle 200 that occurs when the right-turn vehicle 200 is to turn right at an intersection is sensed in accordance with first obtaining information obtained from the right-turn vehicle 200, and information (sensing result) about a moving object in the blind-spot area is output from the output unit 14 directly to the right-turn vehicle 200 (second device). This enables the right-turn vehicle 200 to flexibly (comfortably) determine whether to turn right. In addition, information (sensing result) about a moving object in the blind-spot area, rather than information about all moving objects around the oncoming vehicle 100, is output to the right-turn vehicle 200, which can lead to a reduction in the amount of vehicle-to-vehicle communication. In this way, the travel of the right-turn vehicle 200 can be controlled (to determine whether to turn right or to be kept at standstill) with a small amount of communication in accordance with traffic in a blind-spot area that occurs at an intersection (for example, a blind-spot area that occurs due to the presence of the oncoming vehicle 100).

Second Embodiment

A second embodiment will be described with reference to FIG. 7. The configuration of vehicles 100 and 200 according to the second embodiment is the same as that according to the first embodiment except for the following point and is not described herein. The sensing determination unit 11 determines whether to sense a blind-spot area of the right-turn vehicle 200 on the basis of, for example, third obtaining information indicating an image in which the vehicle (right-turn vehicle) 200 in the lane opposite to the lane in which the vehicle (oncoming vehicle) 100 is currently located appears, which is obtained by the camera 120 mounted on the vehicle (oncoming vehicle) 100, and the detection of a right/left turn (a right turn) of the vehicle (right-turn vehicle) 200 includes detecting a right/left turn (a right turn) of the vehicle (right-turn vehicle) 200 by using the oncoming vehicle 100 ahead of the vehicle (right-turn vehicle) 200. In the following, the operation of the oncoming vehicle 100 and the right-turn vehicle 200 according to the second embodiment will be mainly described, focusing on differences from that according to the first embodiment.

Figure 7:
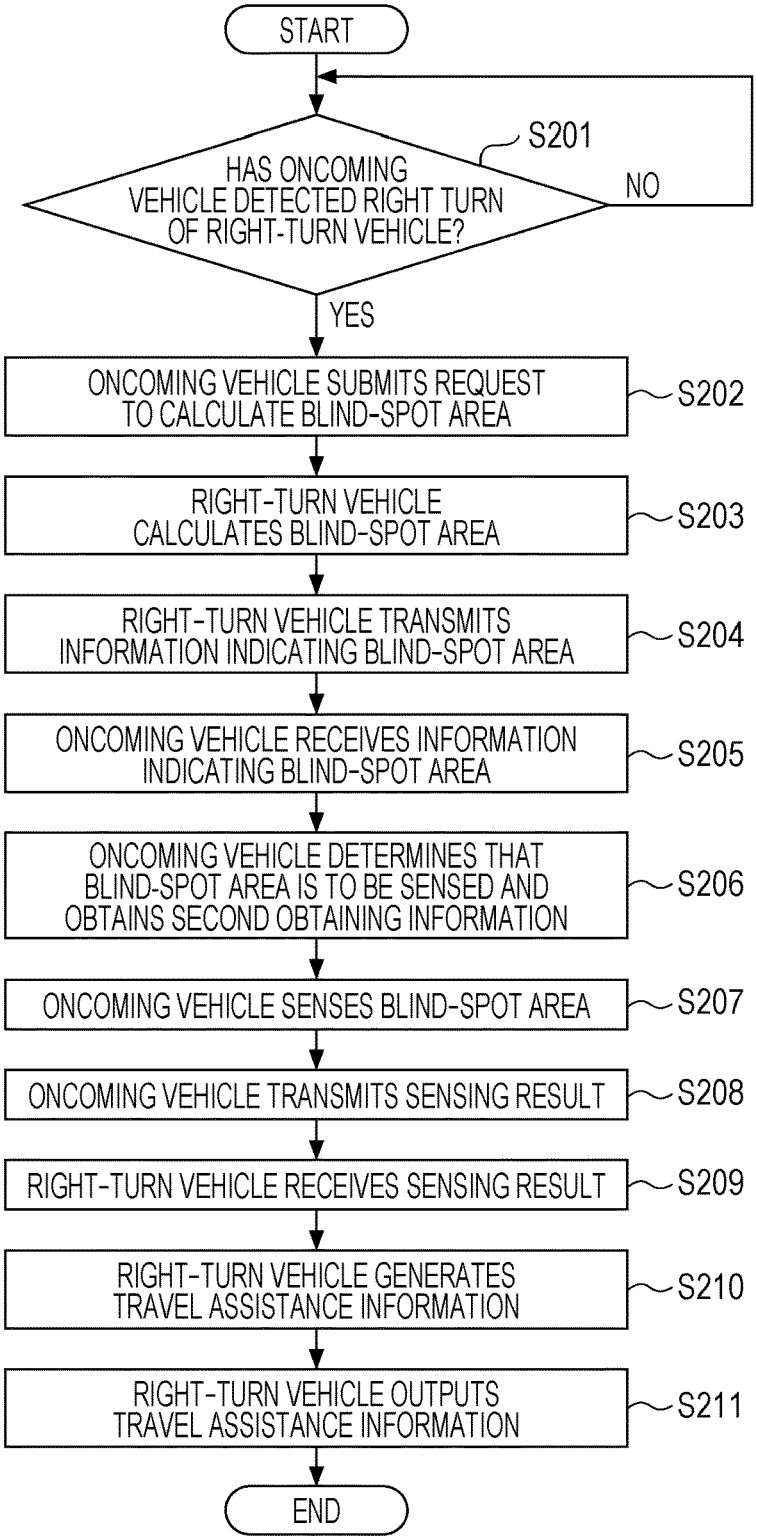
FIG. 7 is a flowchart illustrating an example operation of a vehicle according to a second embodiment.

FIG. 7 is a flowchart illustrating an example operation of the vehicles 100 and 200 according to the second embodiment.

First, the first obtaining unit 16 (the oncoming vehicle 100) obtains third obtaining information indicating an image in which a vehicle in the lane opposite to the lane in which the vehicle 100 is currently located appears. The oncoming vehicle 100 determines accordingly whether a right turn of the right-turn vehicle 200 has been detected (whether the vehicle appearing in the image indicated by the third obtaining information is a right/left-turn vehicle) (step S201). In accordance with the determination, the determination unit 21 determines whether to calculate a blind-spot area. Specifically, the oncoming vehicle 100 requests the right-turn vehicle 200 to calculate a blind-spot area of the right-turn vehicle 200 (step S202), and the determination unit 21 (the right-turn vehicle 200) calculates a blind-spot area in response to the request (step S203). In the second embodiment, in this way, a right turn of the vehicle (right-turn vehicle) 200 is detected by the oncoming vehicle 100 ahead of the vehicle (right-turn vehicle) 200, and the determination unit 21 determines whether to calculate a blind-spot area of the vehicle (right-turn vehicle) 200 in accordance with a detection result obtained by the oncoming vehicle 100 as a result of detecting a right turn of the vehicle (right-turn vehicle) 200. The oncoming vehicle 100 may use any method to detect a right turn of the right-turn vehicle 200. For example, the oncoming vehicle 100 may detect a right turn of the right-turn vehicle 200 by recognizing the blinking of the right-turn directional indicator of the right-turn vehicle 200 or the steering angle of the right-turn vehicle 200 on an image captured by the camera 120.

Then, the first output unit 23 (the right-turn vehicle 200) transmits information indicating the blind-spot area calculated by the calculation unit 22 to the oncoming vehicle 100 (step S204), and the oncoming vehicle 100 receives the information transmitted from the right-turn vehicle 200 (step S205).

In the way described above, the sensing determination unit 11 determines whether to sense a blind-spot area of a right/left-turn vehicle in accordance with whether a vehicle appearing in the image indicated by the third obtaining information is a right/left-turn vehicle.

Then, the sensing determination unit 11 (the oncoming vehicle 100) determines that a blind-spot area of the right-turn vehicle 200 is to be sensed, and the second obtaining unit 12 obtains second obtaining information for determining a blind-spot area of the right-turn vehicle 200 that is determined to be sensed by the sensing determination unit 11 (step S206). Accordingly, an image obtained by the camera 120 mounted on the oncoming vehicle 100 can be used to determine whether the right-turn vehicle 200 is to turn right, and the determination of whether to sense a blind-spot area can be easily performed.

The processing of steps S207 to S211 is the same or substantially the same as the processing of steps S106 to S110 and is not described herein.

In the second embodiment, as described above, the oncoming vehicle 100 detects a right turn of the right-turn vehicle 200, which triggers control for the state of traffic in a blind-spot area that occurs at an intersection. That is, upon detecting a right turn of the right-turn vehicle 200, the oncoming vehicle 100 may initiate an operation for allowing the right-turn vehicle 200 to turn right without receipt of a request from the right-turn vehicle 200.

Third Embodiment

A third embodiment will be described with reference to FIGS. 8, 9, 10A, and 10B.

Figure 8:
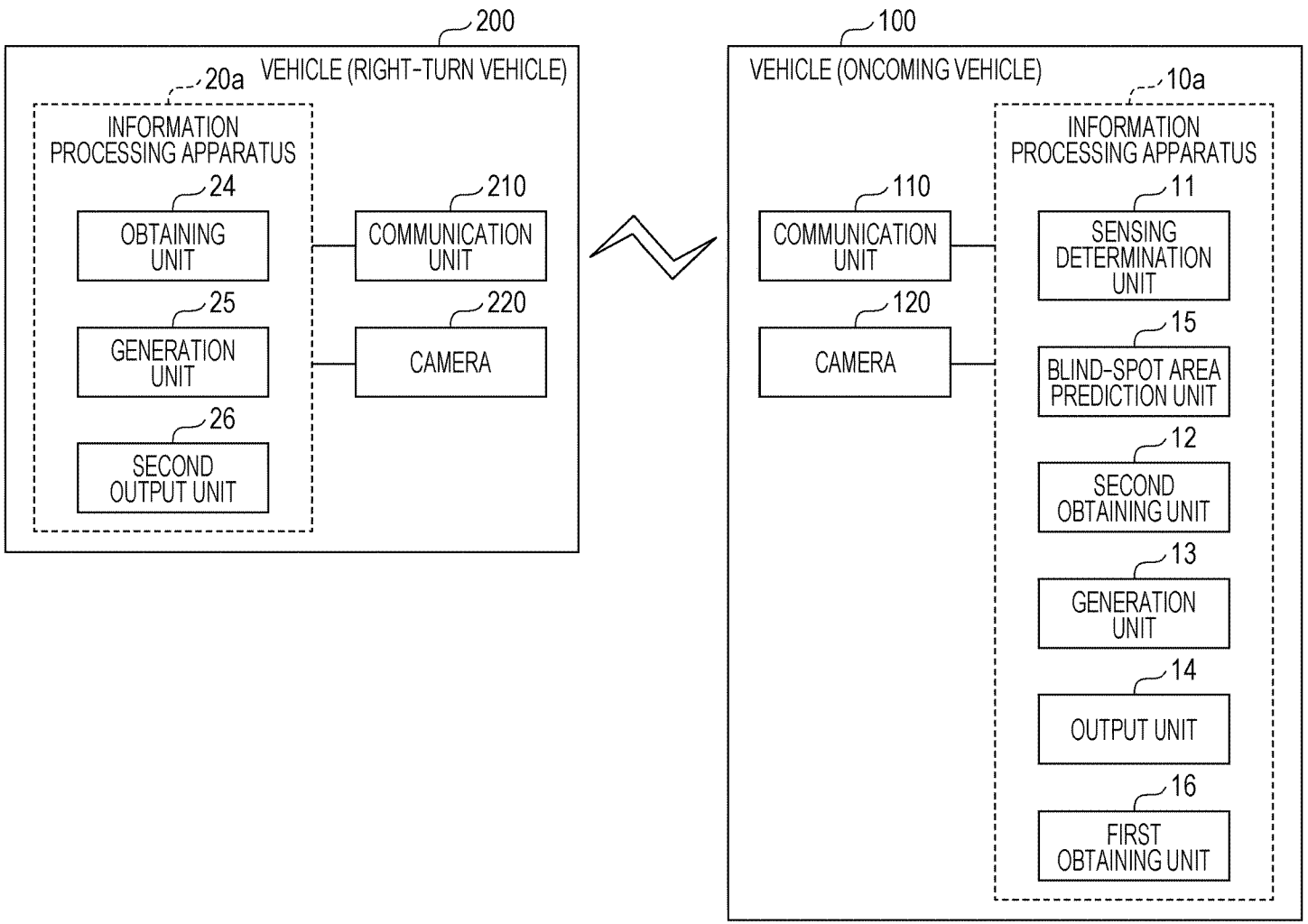
FIG. 8 is a block diagram illustrating an example configuration of a vehicle according to a third embodiment.

FIG. 8 is a block diagram illustrating an example configuration of vehicles 100 and 200 according to the third embodiment.

Unlike the first embodiment, the oncoming vehicle 100 according to the third embodiment includes an information processing apparatus 10*a* in place of the information processing apparatus 10, and the right-turn vehicle 200 according to the third embodiment includes an information processing apparatus 20*a* in place of the information processing apparatus 20. Unlike the information processing apparatus 10, the information processing apparatus 10*a* further includes a blind-spot area prediction unit 15. Unlike the information processing apparatus 10, the information processing apparatus 20*a* does not include the determination unit 21, the calculation unit 22, or the first output unit 23. Other features are the same or substantially the same as those in the first embodiment and are not described herein. In the following, the operation of the oncoming vehicle 100 and the right-turn vehicle 200 according to the third embodiment will be mainly described, focusing on differences from that according to the first embodiment.

Figure 9:
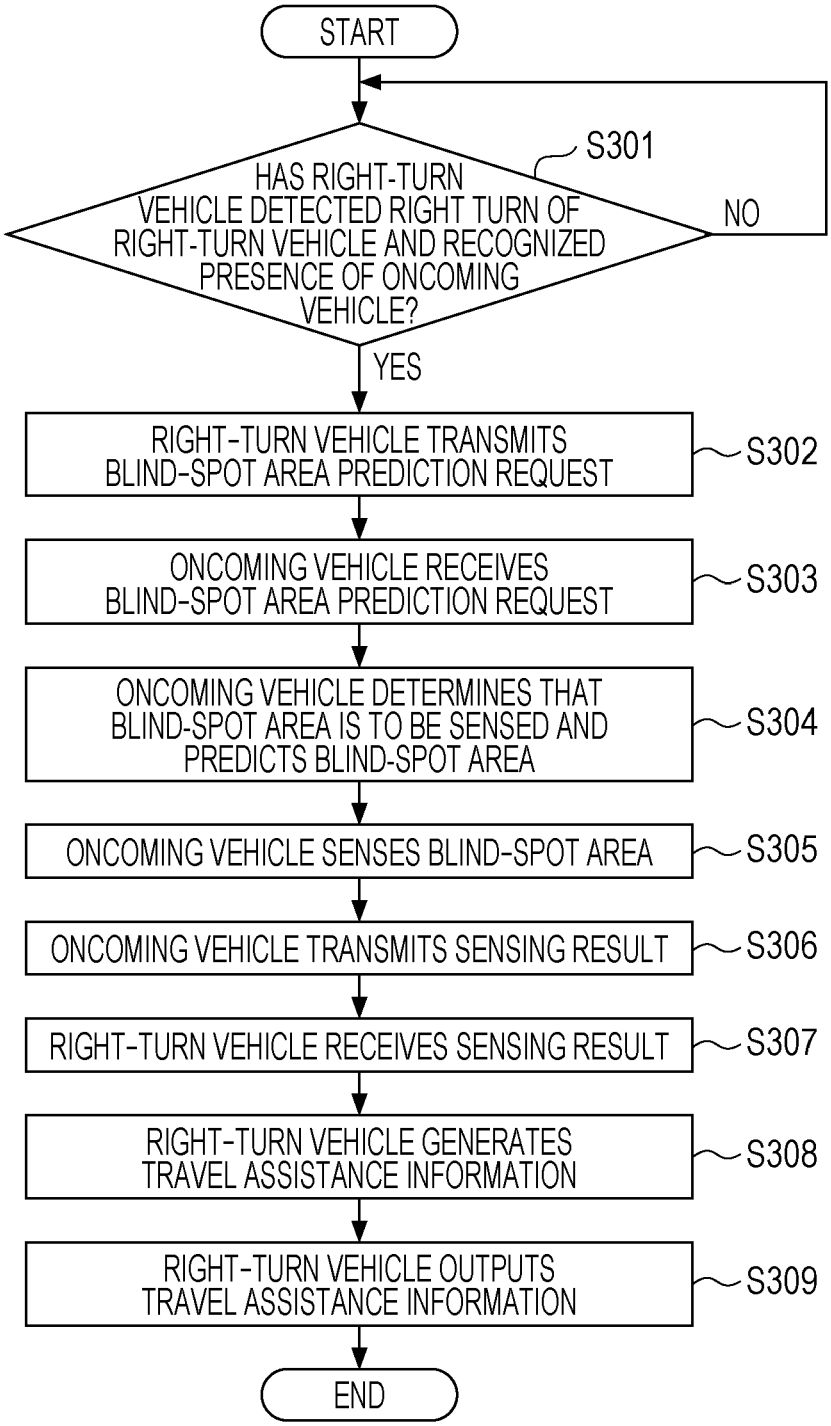
FIG. 9 is a flowchart illustrating an example operation of the vehicle according to the third embodiment.

FIG. 9 is a flowchart illustrating an example operation of the vehicles 100 and 200 according to the third embodiment.

First, the right-turn vehicle 200 determines whether the right-turn vehicle 200 has detected a right turn of the right-turn vehicle 200 and has recognized the presence of the oncoming vehicle 100 (step S301). In the first embodiment, the determination unit 21 determines in accordance with the determination whether to calculate a blind-spot area of the right-turn vehicle 200, and the calculation unit 22 calculates a blind-spot area of the right-turn vehicle 200. In the third embodiment, in contrast, since the information processing apparatus 20*a* does not include the determination unit 21 or the calculation unit 22, the right-turn vehicle 200 does not calculate a blind-spot area of the right-turn vehicle 200. Accordingly, the right-turn vehicle 200 requests the oncoming vehicle 100 to predict a blind-spot area of the right-turn vehicle 200.

If it is determined that the right-turn vehicle 200 has detected a right turn of the right-turn vehicle 200 and has recognized the presence of the oncoming vehicle 100 (YES in step S301), the right-turn vehicle 200 transmits a request to the oncoming vehicle 100 via the communication unit 110 to predict a blind-spot area of the right-turn vehicle 200 (step S302).

The oncoming vehicle 100 receives the request transmitted from the right-turn vehicle 200 via the communication unit 210 (step S303). As a result, the first obtaining unit 16 obtains the request (first obtaining information).

Then, the sensing determination unit 11 determines whether to sense a blind-spot area of the right-turn vehicle 200 in accordance with the first obtaining information (blind-spot area prediction request). Specifically, the sensing determination unit 11 determines that a blind-spot area of the right-turn vehicle 200 is to be sensed if the first obtaining unit 16 has obtained the first obtaining information, and determines that a blind-spot area of the right-turn vehicle 200 is not to be sensed if the first obtaining unit 16 has not obtained the first obtaining information. Accordingly, the sensing determination unit 11 (the oncoming vehicle 100) determines that a blind-spot area of the right-turn vehicle 200 is to be sensed, and the blind-spot area prediction unit 15 predicts a blind-spot area of the right-turn vehicle 200 (step S304). The operation of the blind-spot area prediction unit 15 will be described in detail with reference to FIGS. 10A and 10B described below. Then, the second obtaining unit 12 obtains second obtaining information on the basis of a prediction result obtained by the blind-spot area prediction unit 15.

The processing of steps S305 to S309 is the same or substantially the same as the processing of steps S106 to S110 and is not described herein.

Next, a method for predicting a blind-spot area by using the blind-spot area prediction unit 15 will be described with reference to FIGS. 10A and 10B.

Figure 10B:
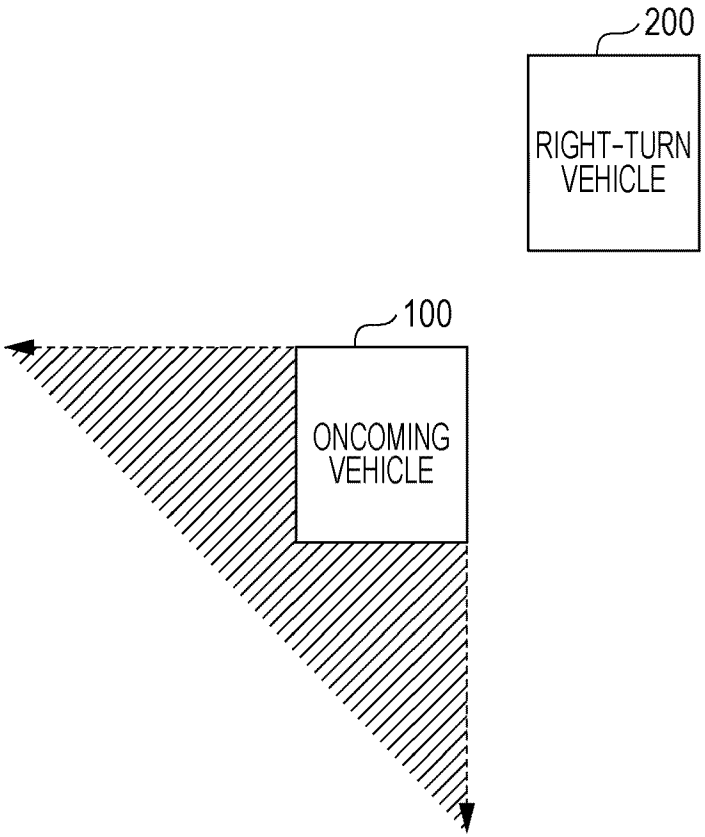
FIGS. 10A and 10B are diagrams illustrating an example method for predicting a blind-spot area.
Figure 10A:
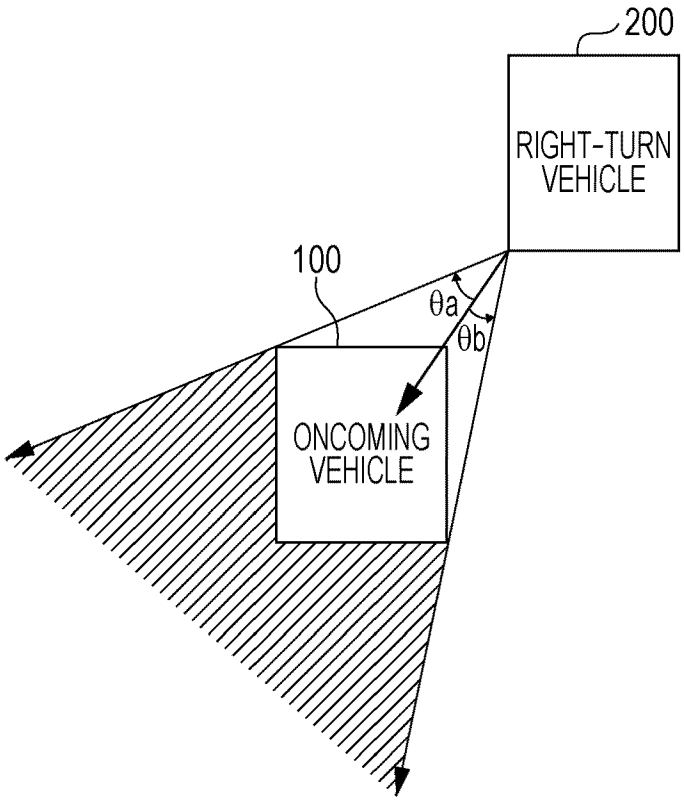

FIGS. 10A and 10B are diagrams illustrating an example method for predicting a blind-spot area. It is assumed that the oncoming vehicle 100 has recognized the positional relationship between the oncoming vehicle 100 and the right-turn vehicle 200 (specifically, the positional relationship between the camera 120 and the camera 220). For example, the oncoming vehicle 100 is capable of recognizing the positional relationship between the oncoming vehicle 100 and the right-turn vehicle 200 from an image obtained by capturing the scene ahead of the oncoming vehicle 100 by using the camera 120.

The blind-spot area prediction unit 15 calculates a blind-spot area of the right-turn vehicle 200 on the basis of the positional relationship between the vehicle (oncoming vehicle) 100 and the right-turn vehicle 200 to predict a blind-spot area of the right-turn vehicle 200. For example, the blind-spot area prediction unit 15 predicts a hatched area illustrated in FIG. 10A as a blind-spot area. Specifically, the blind-spot area prediction unit 15 predicts, based on the positional relationship between the oncoming vehicle 100 and the right-turn vehicle 200, a range of predetermined angles (θa and θb illustrated in FIG. 10A) relative to the direction from the right-turn vehicle 200 to the oncoming vehicle 100 (a thicker-line arrow illustrated in FIG. 10A) as a blind-spot area. For example, the angle θa is formed by the direction from the right-turn vehicle 200 to the oncoming vehicle 100 and a direction from the right-turn vehicle 200 to a corner of the oncoming vehicle 100 (the front left corner of the oncoming vehicle 100 illustrated in FIG. 10A) corresponding to an edge of the blind-spot area, and the angle θb is formed by the direction from the right-turn vehicle 200 to the oncoming vehicle 100 and a direction from the right-turn vehicle 200 to another corner of the oncoming vehicle 100 (the rear right corner of the oncoming vehicle 100 illustrated in FIG. 10A) corresponding to another edge of the blind-spot area.

Alternatively, for example, the blind-spot area prediction unit 15 may predict a hatched area illustrated in FIG. 10B as a blind-spot area. Specifically, the blind-spot area prediction unit 15 may predict a range defined by a direction extending through the front of the oncoming vehicle 100 starting from a corner of the oncoming vehicle 100 close to the right-turn vehicle 200 (the front right corner of the oncoming vehicle 100 illustrated in FIG. 10B) and a direction extending through the right side of the oncoming vehicle 100 starting from the corner of the oncoming vehicle 100 as a blind-spot area.

In the third embodiment, as described above, a blind-spot area of the right-turn vehicle 200 is calculated (predicted) by the oncoming vehicle 100 (another vehicle) rather than by the right-turn vehicle 200 (subject vehicle). Thus, even when the right-turn vehicle 200 does not have a function to calculate a blind-spot area of the right-turn vehicle 200, the oncoming vehicle 100 predicts a blind-spot area of the right-turn vehicle 200, which enables the right-turn vehicle 200 to flexibly (comfortably) determine whether to turn right.

Fourth Embodiment

A fourth embodiment will be described with reference to FIG. 11. The configuration of vehicles 100 and 200 according to the fourth embodiment is the same or substantially the same as that according to the third embodiment and is not described herein. In the fourth embodiment, the right-turn vehicle 200 may not necessarily include the camera 220. In the following, the operation of the oncoming vehicle 100 and the right-turn vehicle 200 according to the fourth embodiment will be described, focusing on differences from that according to the third embodiment.

Figure 11:
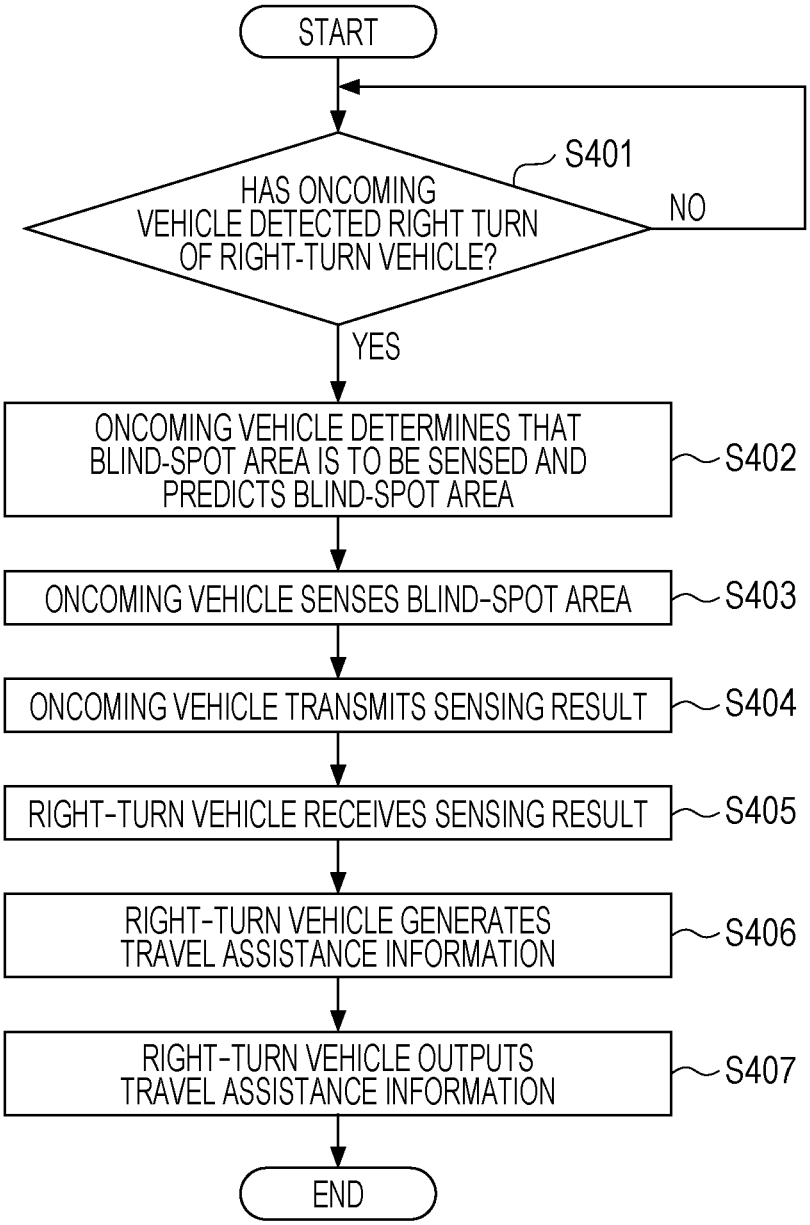
FIG. 11 is a flowchart illustrating an example operation of a vehicle according to a fourth embodiment.

FIG. 11 is a flowchart illustrating an example operation of the vehicles 100 and 200 according to the fourth embodiment.

First, the first obtaining unit 16 (the oncoming vehicle 100) obtains third obtaining information indicating an image in which a vehicle in the lane opposite to the lane in which the vehicle 100 is currently located appears. The oncoming vehicle 100 determines accordingly whether a right turn of the right-turn vehicle 200 has been detected (whether the vehicle appearing in the image indicated by the third obtaining information is a right/left-turn vehicle) (step S401). In the third embodiment, the right-turn vehicle 200 detects a right turn of the right-turn vehicle 200, whereas in the fourth embodiment, the oncoming vehicle 100 detects a right turn of the right-turn vehicle 200. In the way described above, the sensing determination unit 11 determines whether to sense a blind-spot area of a right/left-turn vehicle in accordance with whether the vehicle appearing in the image indicated by the third obtaining information is a right/left-turn vehicle.

Then, the sensing determination unit 11 (the oncoming vehicle 100) determines that a blind-spot area of the right-turn vehicle 200 is to be sensed, and the blind-spot area prediction unit 15 predicts a blind-spot area of the right-turn vehicle 200 (step S402). Then, the second obtaining unit 12 obtains second obtaining information on the basis of a prediction result obtained by the blind-spot area prediction unit 15.

The processing of steps S403 to S407 is the same or substantially the same as the processing of steps S305 to S309 and is not described herein.

In the fourth embodiment, as described above, the oncoming vehicle 100 detects a right turn of the right-turn vehicle 200, which triggers control for the state of traffic in a blind-spot area that occurs at an intersection. In the fourth embodiment, furthermore, the right-turn vehicle 200 does not calculate a blind-spot area but the oncoming vehicle 100 predicts a blind-spot area. Thus, upon detecting a right turn of the right-turn vehicle 200, the oncoming vehicle 100 can initiate an operation for allowing the right-turn vehicle 200 to turn right without receipt of a request from the right-turn vehicle 200. In addition, if the right-turn vehicle 200 does not have a function to calculate a blind-spot area of the right-turn vehicle 200, the oncoming vehicle 100 predicts a blind-spot area of the right-turn vehicle 200, which enables the right-turn vehicle 200 to flexibly (comfortably) determine whether to turn right.

Other Embodiments

While information processing apparatuses according to the first to fourth embodiments of the present disclosure have been described, the present disclosure is not limited to these embodiments. Various modifications conceivable by a person skilled in the art to these embodiments and embodiments achieved by combining constituent elements in different embodiments also fall within the scope of the present disclosure without departing from the spirit and scope of the present disclosure.

For example, the oncoming vehicle 100 and the right-turn vehicle 200 may include a radar, a Light Detection and Ranging or Laser Imaging Detection and Ranging (LIDAR) device, or the like in place of the cameras 120 and 220 or in addition to the cameras 120 and 220, respectively.

In the embodiments described above, furthermore, for example, the right-turn vehicle 200 has a blind-spot area that occurs due to the presence of the oncoming vehicle 100. The right-turn vehicle 200 may also have blind-spot areas that occur due to the presence of obstacles such as pillars to support an elevated bridge. Even in this case, the calculation unit 22 (the right-turn vehicle 200) is capable of calculating areas within which such obstacles appear on images of the scene ahead of the right-turn vehicle 200, which are obtained by the camera 220, as blind-spot areas. The blind-spot area prediction unit 15 (the oncoming vehicle 100) is capable of predicting blind-spot areas that occur due to the presence of the obstacles from the positional relationships regarding the oncoming vehicle 100, the right-turn vehicle 200, and the obstacles.

In the embodiments described above, furthermore, for example, the output unit 14 outputs the first control information to a sensor (for example, the camera 120 mounted on the vehicle 100) and outputs a sensing result received from the sensor to the second device mounted on the right-turn vehicle 200, by way of example but not limitation. For example, the output unit 14 may output the first control information to a first device including a sensor (such as a camera) and may output a sensing result received from the first device to the second device mounted on the right-turn vehicle 200. The first device includes a device mounted on each of the following vehicles 300 that follow the vehicle 100. That is, in the embodiments described above, the vehicle 100 senses a blind-spot area of the right-turn vehicle 200. Alternatively, the vehicle 100 may cause the devices mounted on the following vehicles 300 to sense a blind-spot area of the right-turn vehicle 200 and may output sensing results received from the following vehicles 300 to the second device.

Alternatively, the output unit 14 may output the first control information and information for providing an instruction to output a sensing result to the second device to the first device. Specifically, the information processing apparatus 10 further includes a third obtaining unit that obtains first position information indicating the position of the vehicle 100 and second position information indicating the position of at least one vehicle in a range of vehicles with which the information processing apparatus 10 is capable of communicating, and the generation unit 13 identifies a device(s) mounted on one or more of the following vehicles 300 from the first position information and the second position information. The third obtaining unit may use any method to obtain position information. The position information can be obtained by, for example, using a GPS device, an image sensor, a distance measurement sensor, or the like. Then, the output unit 14 outputs the first control information to the identified device(s) mounted on the following vehicle(s) 300. In the way described above, the output unit 14 may output an instruction to a device(s) mounted on the following vehicle(s) 300 to sense a blind-spot area and to output a sensing result to the second device.

For example, the oncoming vehicle 100 transmits the instruction to a plurality of following vehicles 300 via broadcasting, and each of the plurality of following vehicles 300 transmits a sensing result obtained by sensing a blind-spot area of the right-turn vehicle 200 to the right-turn vehicle 200. This enables the right-turn vehicle 200 to obtain information about a moving object in a blind-spot area of the right-turn vehicle 200 that is behind the oncoming vehicle 100 and that is out of the sensing coverage around the oncoming vehicle 100 ahead of the right-turn vehicle 200. For example, if the straight-ahead vehicle 400 moves from outside the area that can be sensed by the camera 120 included in the oncoming vehicle 100 within a blind-spot area of the right-turn vehicle 200 and is to travel straight ahead through an intersection at a very high speed, each of the following vehicles 300 transmits a sensing result indicating that the straight-ahead vehicle 400 is to travel straight ahead through the intersection at a very high speed to the right-turn vehicle 200, which enables the right-turn vehicle 200 to flexibly (comfortably) determine whether to turn right.

In the embodiments described above, furthermore, for example, the travel assistance information is information for controlling the travel of the vehicle (right-turn vehicle) 200. Alternatively, the travel assistance information may be information to be presented to the passenger(s) of the vehicle (right-turn vehicle) 200. For example, information to be presented to the passenger(s) of the right-turn vehicle 200 includes either image (text) information or audio information, or both. When the right-turn vehicle 200 is a manual driving vehicle, information indicating whether the right-turn vehicle 200 can turn right can be presented to the passenger (driver) of the right-turn vehicle 200. When the right-turn vehicle 200 is an automatic driving vehicle, information indicating whether the right-turn vehicle 200 is to turn right or to be kept at standstill can be presented to the passenger(s) of the right-turn vehicle 200. Such information is presented via a display, speakers, or any other suitable device included in the right-turn vehicle 200, for example. The information to be presented to the passenger(s) of the right-turn vehicle 200 may be, for example, an image in which a blind-spot area of the right-turn vehicle 200 appears, which is captured by a camera included in the oncoming vehicle 100 (the following vehicles 300). The image is transmitted to the right-turn vehicle 200 and is displayed on a display included in the right-turn vehicle 200, which may allow the passenger (driver) to determine whether to turn right or to be kept at standstill. The image may be superimposed on an area within which the oncoming vehicle 100 (an obstacle) appears in an image captured by the camera 220 included in the right-turn vehicle 200 to obtain an image in which the blind-spot area can be seen through the oncoming vehicle 100 (an obstacle) which may be displayed on a display included in the right-turn vehicle 200.

An embodiment of the present disclosure may be implemented not only as an information processing apparatus but also as a method including steps (processes) performed by constituent elements of the information processing apparatus.

The steps may be executed by a computer (computer system), for example. An embodiment of the present disclosure may be implemented as a program for causing the computer to execute the steps included in the method. An embodiment of the present disclosure may also be implemented as a non-transitory computer-readable recording medium storing the program, such as a compact disc read-only memory (CD-ROM).

For example, a program according to an embodiment of the present disclosure is a program for controlling the operation of the information processing apparatus 10, which is mounted on the vehicle 100. The operation of the information processing apparatus 10 includes (i) obtaining, from a right/left-turn vehicle 200 in the lane opposite to the lane in which the vehicle 100 is currently located, first obtaining information for providing an instruction to sense a blind-spot area of the right/left-turn vehicle 200, (ii) determining whether to sense a blind-spot area of the right/left-turn vehicle 200 in accordance with the first obtaining information, (iii) obtaining second obtaining information for determining a blind-spot area of the right/left-turn vehicle 200 that is determined to be sensed, (iv) generating first control information for controlling sensing of the blind-spot area determined from the obtained second obtaining information, and (v-1) outputting the first control information to a sensor or a first device including the sensor, and outputting a sensing result received from the sensor or the first device to a second device mounted on the right/left-turn vehicle 200, or (v-2) outputting to the first device the first control information and information for providing an instruction to output the sensing result to the second device.

In addition, for example, a program according to an embodiment of the present disclosure is a program for controlling the operation of the information processing apparatus 10, which is mounted on the vehicle 100. The operation of the information processing apparatus 10 includes (i) obtaining third obtaining information indicating an image in which a vehicle in the lane opposite to the lane in which the vehicle 100 is currently located appears, (ii) determining, based on whether the vehicle appearing in the image indicated by the third obtaining information is the right/left-turn vehicle 200, whether to sense a blind-spot area of the right/left-turn vehicle 200, (iii) obtaining second obtaining information for determining a blind-spot area of the right/left-turn vehicle 200 that is determined to be sensed, (iv) generating first control information for controlling sensing of the blind-spot area determined from the obtained second obtaining information, and (v-1) outputting the first control information to a sensor or a first device including the sensor, and outputting a sensing result received from the sensor or the first device to a second device mounted on the right/left-turn vehicle 200, or (v-2) outputting to the first device the first control information and information for providing an instruction to output the sensing result to the second device.

In addition, for example, a program according to an embodiment of the present disclosure is a program for controlling the operation of the information processing apparatus 20, which is mounted on the vehicle 200. The operation of the information processing apparatus 20 includes (i) determining whether to calculate a blind-spot area of the vehicle 200 in response to detecting a right/left turn of the vehicle 200, (ii) calculating a blind-spot area of the vehicle 200 in accordance with information on surroundings of the vehicle 200, (iii) outputting information indicating the blind-spot area, (iv) receiving a result of sensing the blind-spot area, (v) generating travel assistance information for assisting travel of the vehicle 200 in accordance with the result of sensing the blind-spot area, and (vi) outputting the travel assistance information to a device mounted on the vehicle 200.

For example, when an embodiment of the present disclosure is implemented as a program (software), the program is executed by using hardware resources of the computer, such as a central processing unit (CPU), a memory, and an input/output circuit, and the steps are executed accordingly. That is, the CPU obtains data from the memory, the input/output circuit, or the like for calculation and outputs the result of the calculation to the memory, the input/output circuit, or the like, and the steps are executed accordingly.

The plurality of constituent elements included in the information processing apparatus according to the embodiments described above may be each implemented as a specific or general-purpose circuit. These constituent elements may be implemented as a single circuit or as a plurality of circuits.

The plurality of constituent elements included in the information processing apparatus according to the embodiments described above may be implemented as a large scale integration (LSI) circuit that is an integrated circuit (IC). These constituent elements may be formed as individual chips or some or all of the constituent elements may be integrated into a single chip. LSI may be called system LSI, super LSI, or ultra LSI depending on the degree of integration.

In addition, an integrated circuit may be implemented by a dedicated circuit or a general-purpose processor instead of by LSI. A field programmable gate array (FPGA) that is programmable or a reconfigurable processor in which the connection or setting of circuit cells in the LSI is reconfigurable may be used.

Other embodiments, such as embodiments achieved by making various modifications conceivable by a person skilled in the art to the embodiments or embodiments achieved by any combination of constituent elements and functions in the embodiments without departing from the spirit and scope of the present disclosure, are also included in the present disclosure.

The present disclosure is applicable to an automatic driving vehicle, for example.

What is claimed is:

1. An apparatus equipped in a vehicle, the apparatus comprising:

a processor; and a memory storing thereon a computer program, which when executed by the processor, causes the processor to perform operations including:

obtaining, from a right- or left-turn vehicle in a lane opposite to a lane in which the vehicle is currently located, first information for providing an instruction to sense a blind-spot area of the right- or left-turn vehicle;

determining whether to sense the blind-spot area of the right- or left-turn vehicle in accordance with the first information;

obtaining second information for determining the blind-spot area of the right- or left-turn vehicle that is determined to be sensed;

generating first control information for controlling sensing of the blind-spot area determined from the obtained second information; and outputting the first control information, wherein the outputting includes outputting the first control information to (i) a sensor or (ii) a first device including the sensor and outputting a sensing result received from the sensor or the first device to a second device mounted on the right- or left-turn vehicle, or outputting (i) the first control information and (ii) an instruction to output the sensing result to the second device, to the first device.

2. The apparatus according to claim 1, wherein the blind-spot area includes a blind-spot area that occurs due to presence of the vehicle.

3. The apparatus according to claim 2, wherein the obtaining of the second information calculates the blind-spot area on the basis of a positional relationship between the vehicle and the right- or left-turn vehicle to obtain the second information.

4. The apparatus according to claim 2, wherein the obtaining of the second information obtains the second information from the right- or left-turn vehicle.

5. The apparatus according to claim 1, wherein the operations further include obtaining (i) first position information indicating a position of the vehicle and (ii) second position information indicating a position of at least one vehicle in a range of vehicles with which the apparatus is capable of communicating, wherein the first device includes a device mounted on a following vehicle that follows the vehicle, wherein the generating identifies the device mounted on the following vehicle by using the first position information and the second position information, and wherein the outputting outputs the first control information to the identified device mounted on the following vehicle.

6. An apparatus equipped in a vehicle, the apparatus comprising:

a processor; and a memory storing thereon a computer program, which when executed by the processor, causes the processor to perform operations including:

obtaining an image in which another vehicle in a lane opposite to a lane in which the vehicle is currently located appears;

determining, based on whether the other vehicle appearing in the image is a right- or left-turn vehicle, whether to sense a blind-spot area of the right- or left-turn vehicle;

obtaining blind-spot area information for determining the blind-spot area of the right- or left-turn vehicle that is determined to be sensed;

generating first control information for controlling sensing of the blind-spot area determined from the obtained blind-spot information; and outputting the first control information, wherein the outputting includes outputting the first control information to (i) a sensor or (ii) a first device including the sensor and outputting a sensing result received from the sensor or the first device to a second device mounted on the right- or left-turn vehicle, or outputting (i) the first control information and (ii) an instruction to output the sensing result to the second device, to the first device.

7. An apparatus equipped in a vehicle, the apparatus comprising:

a processor; and a memory storing thereon a computer program, which when executed by the processor, causes the processor to perform operations including:

detecting a right or left turn of the vehicle;

determining whether to calculate a blind-spot area of the vehicle in accordance with a result of detecting the right or left turn of the vehicle, the blind-spot area occurring due to presence of an oncoming vehicle in a lane opposite to a lane in which the vehicle is currently located;

calculating the blind-spot area of the vehicle using a positional relationship between the vehicle and the oncoming vehicle;

outputting the blind-spot area to an external apparatus via wireless communication;

receiving a result of sensing the blind-spot area from the external apparatus via wireless communication;

generating travel assistance information for assisting travel of the vehicle in accordance with the result of sensing the blind-spot area; and outputting the travel assistance information to a device mounted on the vehicle.

8. The apparatus according to claim 7, wherein the detecting detects a right or left turn of the vehicle in accordance with information indicating turning on of a directional indicator included in the vehicle.

9. The apparatus according to claim 7, wherein the detecting includes detecting, by the oncoming vehicle in the lane opposite to the lane in which the vehicle is currently located, the right or left turn of the vehicle, and wherein the determining determines whether to calculate the blind-spot area of the vehicle in accordance with a result of detecting the right or left turn of the vehicle, the result being received from the oncoming vehicle.

10. The apparatus according to claim 7, wherein the generating generates the travel assistance information to make the vehicle stop turning right or left when the result of sensing the blind-spot indicates presence of an object in the blind-spot area.

11. The apparatus according to claim 7, wherein the generating generates the travel assistance information to allow the vehicle to turn right or left when the result of sensing the blind-spot indicates no object in the blind-spot area.

12. The apparatus according to claim 7, wherein the travel assistance information is information for controlling travel of the vehicle.

13. The apparatus according to claim 7, wherein the travel assistance information is information to be presented to a passenger of the vehicle.

14. The apparatus according to claim 7, wherein the external apparatus is the oncoming vehicle.

15. A non-transitory recording medium storing thereon a computer program for controlling an apparatus equipped in a vehicle, which when executed by the processor, causes the processor to perform operations comprising:

obtaining, from a right- or left-turn vehicle in a lane opposite to a lane in which the vehicle is currently located, first information for providing an instruction to sense a blind-spot area of the right- or left-turn vehicle;

determining whether to sense a blind-spot area of the right- or left-turn vehicle in accordance with the first information;

obtaining second information for determining the blind-spot area of the right- or left-turn vehicle that is determined to be sensed;

generating first control information for controlling sensing of the blind-spot area determined from the obtained second information; and outputting the first control information to (i) a sensor or (ii) a first device including the sensor and outputting a sensing result received from the sensor or the first device to a second device mounted on the right- or left-turn vehicle, or outputting (i) the first control information and (ii) an instruction to output the sensing result to the second device, to the first device.

16. A non-transitory recording medium storing thereon a computer program for controlling an apparatus equipped in a vehicle, which when executed by the processor, causes the processor to perform operations comprising:

obtaining an image in which another vehicle in a lane opposite to a lane in which the vehicle is currently located appears;

determining, based on whether the other vehicle appearing in the image indicated is a right- or left-turn vehicle, whether to sense a blind-spot area of the right- or left-turn vehicle;

obtaining blind-spot area information for determining the blind-spot area of the right- or left-turn vehicle that is determined to be sensed;

generating first control information for controlling sensing of the blind-spot area determined from the obtained blind-spot area information; and outputting the first control information to (i) a sensor or (ii) a first device including the sensor and outputting a sensing result received from the sensor or the first device to a second device mounted on the right- or left-turn vehicle, or outputting (i) the first control information and (ii) an instruction to output the sensing result to the second device, to the first device.

17. A non-transitory recording medium storing thereon a computer program for controlling an apparatus equipped in a vehicle, which when executed by the processor, causes the processor to perform operations comprising:

detecting a right or left turn of the vehicle;

determining whether to calculate a blind-spot area of the vehicle in accordance with a result of detecting a right or left turn of the vehicle, the blind-spot area occurring due to presence of an oncoming vehicle in a lane opposite to a lane in which the vehicle is currently located;

calculating a blind-spot area of the vehicle using a positional relationship between the vehicle and the oncoming vehicle;

outputting the blind-spot area to an external apparatus via wireless communication;

receiving a result of sensing the blind-spot area from the external apparatus via wireless communication;

generating travel assistance information for assisting travel of the vehicle in accordance with the result of sensing the blind-spot area; and outputting the travel assistance information to a device mounted on the vehicle.

* * * * *